US010869793B1

(12) United States Patent
Runnels

(10) Patent No.: US 10,869,793 B1
(45) **Date of Patent: *Dec. 22, 2020**

(54) APPARATUS AND METHOD FOR MOBILITY DEVICE LIFTING AND POSITIONING

(71) Applicant: LEXIA . SOLUTIONS, INC., Nashville, TN (US)

(72) Inventor: Jeffrey Runnels, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/548,997

(22) Filed: Aug. 23, 2019

Related U.S. Application Data

(63) Continuation of application No. 15/839,480, filed on Dec. 12, 2017, now Pat. No. 10,406,047.

(60) Provisional application No. 62/433,130, filed on Dec. 12, 2016.

(51) Int. Cl.
*A61G 5/10* (2006.01)

(52) U.S. Cl.
CPC ..... *A61G 5/104* (2013.01)

(58) Field of Classification Search
CPC ..... A61G 5/104; A61G 7/10
USPC ..... 414/678, 921, 539, 546
See application file for complete search history.

(56) References Cited

U.S. PATENT DOCUMENTS 2,574,236 A 11/1951 Arner, Sr.
3,172,501 A * 3/1965 Ramer ..... B66F 7/04 187/244
3,685,125 A 8/1972 Depierre
3,888,463 A * 6/1975 O'Brien ..... A61G 3/063 254/10 C
4,273,217 A 6/1981 Kajita
RE31,178 E 3/1983 Deacon
4,466,771 A * 8/1984 Thorley ..... B60P 1/4421 105/431
4,726,730 A 2/1988 McConnell
4,926,973 A 5/1990 Smith
4,953,665 A 9/1990 Paquin
5,105,915 A 4/1992 Gary
5,180,275 A 1/1993 Czech et al.
5,553,990 A 9/1996 Kytola, Sr.
6,619,620 B1 * 9/2003 Carter ..... B66F 7/08 254/10 C
7,445,416 B2 11/2008 O'Leary et al.
7,926,618 B2 * 4/2011 Zuercher ..... B60P 1/4471 187/200
8,783,419 B2 7/2014 Zuercher
(Continued)

*Primary Examiner* — Lynn E Schwenning
(74) *Attorney, Agent, or Firm* — Patterson Intellectual Property Law, P.C.; Scott M. Douglass; Alex H Huffstutter

(57) ABSTRACT

Apparatuses, systems, and methods for providing mobility device lifting and positioning are provided. An apparatus for positioning a mobility device above a ground surface comprises at least one support structure and a platform. The at least one support structure includes a lower surface, a plurality of retractable wheels, and at least one lifting mechanism. The at least one support structure is support on the ground surface using one of the lower surface or the plurality of retractable wheels. The platform is coupled to the at least one lifting mechanism, the platform is configurable in at least one of a first configuration or a second configuration. The at least one support structure is supported on the ground surface by the plurality of retractable wheels in one of the first configuration or the second configuration.

20 Claims, 28 Drawing Sheets

(56) References Cited

U.S. PATENT DOCUMENTS

| | | | | |
|---|---|---|---|---|
| 10,160,628 | B2 * | 12/2018 | Wells | B66F 7/16 |
| 10,406,047 | B1 * | 9/2019 | Runnels | A61G 5/104 |
| 2001/0008344 | A1 | 7/2001 | Lanciaux, Jr. | |
| 2006/0182581 | A1 | 8/2006 | Murray et al. | |
| 2008/0042114 | A1 | 2/2008 | Stanislao | |
| 2017/0181911 | A1 | 6/2017 | Fakhrizadeh | |

* cited by examiner

APPARATUS AND METHOD FOR MOBILITY DEVICE LIFTING AND POSITIONING

CROSS-REFERENCES TO RELATED APPLICATIONS

This application is a continuation application of U.S. Non-Provisional patent application Ser. No. 15/839,480 filed Dec. 12, 2017, entitled "Apparatus and Method for Mobility Device Lifting and Positioning," which claims priority to U.S. Provisional Application No. 62/433,130 filed Dec. 12, 2016, entitled "Wheelchair Lift Apparatus."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present disclosure relates generally to an apparatus and method for mobility device lifting and positioning.

More particularly, the present disclosure relates to a wheelchair lift apparatus for a raised seating or standing area such as a bar or elevated eating counter, a high top table, casino tables, elevated work stations, standing areas at concerts, raised business counters such as bank telling windows, etc. Traditional raised seating or standing areas are not equipped with any type of lift to accommodate individuals confined to a wheelchair. As such, when wheelchair confined patrons frequent the business or locality having the raised seating or standing area, the wheel-chaired patrons are disadvantaged as their eye level when seated in a wheelchair is typically below the raised structure such as a bar, tabletop, or countertop. Similarly, standing areas at concerts typically do not have accommodations for patrons confined to a wheelchair to have a similar line of sight as patrons standing. In a social setting such a configuration can make the wheelchair patron feel left out as they are positioned generally below their friends and companions. Likewise, persons confined to wheelchairs may feel left out when attending an event with a standing section because ticketing options are limited for such persons to areas with clear lines of sight to the performance. In a business setting, it can be difficult for the individual in the wheelchair to see over the raised counter to conduct business effectively.

Conventional wheelchair lifts are large and bulky and can include complicated railing systems that would not allow the lift to move properly if the lift is positioned beneath a raised structure such as a bar or counter. Additionally, in a social setting, the large footprint of traditional wheelchair lifts can consume valuable real estate within the bar or restaurant that would need to be designated for wheelchair patrons only, which would deter the use of such lifts in a bar or restaurant setting as the area consumed by the lifts would not be readily useable to service non-wheelchair patrons. Conventional lifts also require semi-permanent installation, further detracting from their use in business settings because they cannot be easily moved or stored when not in use.

BRIEF SUMMARY OF THE INVENTION

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to one aspect of the present disclosure, there is provided an apparatus for positioning a mobility device above a ground surface. The apparatus comprises at least one support structure and a platform. The at least one support structure includes a lower surface, a plurality of retractable wheels, and at least one lifting mechanism. The at least one support structure is supported on the ground surface using one of the lower surface or the plurality of retractable wheels. The platform is coupled to the at least one lifting mechanism. The platform is configurable in at least one of a first configuration or a second configuration. The at least one support structure is supported on the ground surface by the plurality of retractable wheels in one of the first configuration or the second configuration.

According to another aspect of the apparatus of the present disclosure, the at least one support structure includes a first support structure. The platform includes a first side edge and a second side edge opposite to the first side edge. The first side edge is positioned adjacent to the first support structure. The first side edge is positioned closer to the ground surface than the second side edge when the platform is in the first configuration.

According to another aspect of the apparatus of the present disclosure, the plurality of retractable wheels are configured to extend beyond the lower surface of the at least one support structure in response to the first configuration.

According to another aspect of the apparatus of the present disclosure, the at least one support structure includes a first support structure. The platform includes a first side edge and a second side edge opposite to the first side edge. The first side edge is positioned adjacent to the first support structure. The first and second side edges are positioned substantially a same distance from the ground surface when the platform is in the second configuration.

According to another aspect of the apparatus of the present disclosure, the plurality of retractable wheels are configured to retract within the at least one support structure in response to the second configuration.

According to another aspect of the apparatus of the present disclosure, the apparatus further comprises at least one ramp pivotally coupled to an edge of the platform.

According to another aspect of the apparatus of the present disclosure, the platform includes a first edge and a second edge. The first and second edges extend away from the at least one support structure. The at least one ramp includes a first ramp coupled along the first edge of the platform and includes a second ramp coupled along the second edge of the platform.

According to another aspect of the apparatus of the present disclosure, the at least one ramp includes a ramp actuator coupled between the at least one ramp and the platform. The ramp actuator is configured to position the at least one ramp selectively between at least a first position and a second position.

According to another aspect of the apparatus of the present disclosure, the apparatus further comprises a platform support assembly coupled between the at least one lifting mechanism and the platform. The platform support assembly including at least one arm pivotally attached thereto for moving the platform between the first and second configurations.

According to another aspect of the apparatus of the present disclosure, the apparatus further comprises a guide rail system coupled between the platform and the at least one arm of the platform support assembly. The guide rail system is configure to adjust a horizontal position of the platform relative to the at least one support structure.

According to another aspect of the apparatus of the present disclosure, the at least one support structure includes a first support structure and a second support structure. The at least one arm of the platform support assembly is coupled between the at least one lifting mechanism of each of the first and second support structures.

According to another aspect of the apparatus of the present disclosure, the at least one arm includes a first pivot point positioned proximate to the first support structure, includes a second pivot point positioned proximate to the second support structure, and includes a third pivot point positioned between the first pivot point and the second pivot point.

According to another aspect of the apparatus of the present disclosure, the platform is coupled to the at least one arm between the first pivot point and the third pivot point, or between the second pivot point and the third pivot point.

According to further aspects of the present disclosure, there is provided a method of using a lifting device for positioning a mobility device above a ground surface. The method comprises transitioning a lifting platform of the lifting device into one of a first configuration or a second configuration. The method further comprises moving a plurality of wheels of the lifting device between an extended position and a retracted positioned in response to the transitioning of the lifting platform into one of the first configuration or the second configuration. The extended position is associated with the plurality of wheels extending beyond a lower surface of the lifting device.

According to another aspect of the method of the present disclosure, the method includes extending the plurality of wheels beyond a lower surface of the lifting device in response to transitioning the lifting platform into the first configuration.

According to another aspect of the method of the present disclosure, the method includes retracting the plurality of wheels within the lifting device in response to transitioning the lifting platform into the second configuration.

According to another aspect of the method of the present disclosure, the method includes receiving a mobility device upon the lifting platform of the lifting device when the lifting platform is in the second configuration. The method further includes receiving a position command at a control unit of the lifting device. The method still further includes adjusting a height of the lifting platform relative to the ground surface based upon the received position command.

According to another aspect of the method of the present disclosure, the method includes receiving a lateral movement command at the control unit. The method further includes manipulating a lateral position of the lifting platform relative to at least one support structure of the lifting device based at least in part upon the received lateral movement command.

According to another aspect of the method of the present disclosure, the method further includes assisting transitioning the platform between the first configuration and the second configuration using an actuator. The actuator being controlled at least in part by a control unit of the lifting device.

According to another aspect of the method of the present disclosure, the method further includes manipulating a position of at least one ramp coupled to the lifting platform from a lowered position resting on the ground surface to a raised position based at least in part on a command from a control unit of the lifting device.

Numerous other objects, advantages and features of the present disclosure will be readily apparent to those of skill in the art upon a review of the following drawings and description of a preferred embodiment.

Figure 33A:
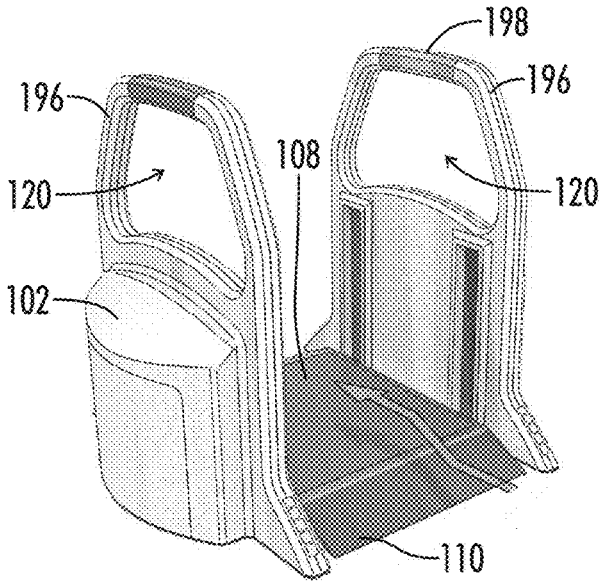
FIG. 33A illustrates a raised front, side perspective view of an exemplary embodiment of an apparatus for positioning a mobility device having a double support structure configuration according to aspects of the present disclosure.
Figure 33B:
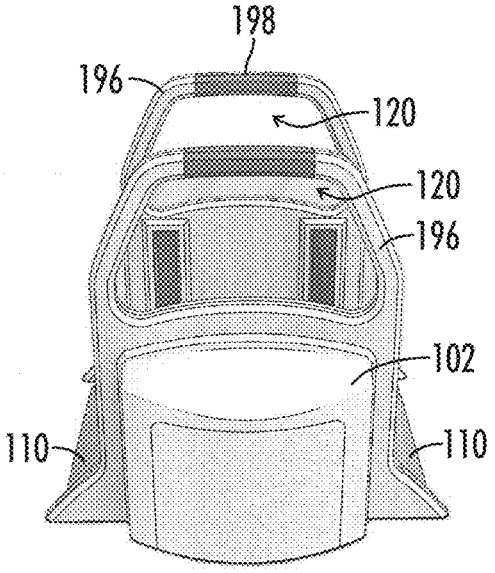
FIG. 33B illustrates a raised side perspective view of an exemplary embodiment of the apparatus for positioning a mobility device of FIG. 33A according to aspects of the present disclosure.
Figure 33C:
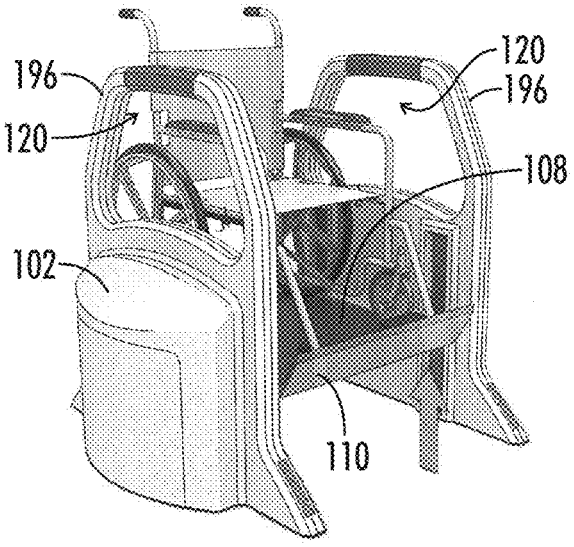
FIG. 33C illustrates a raised front, side perspective view of an exemplary embodiment of the apparatus for positioning a mobility device of FIG. 33A in a lifted platform configuration according to aspects of the present disclosure.
Figure 33D:
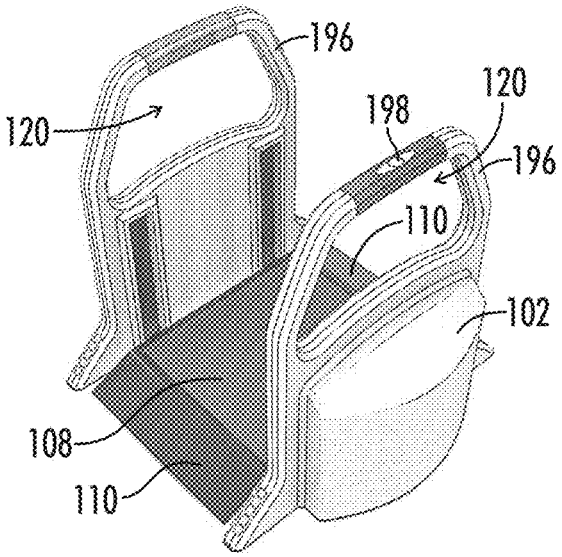

33D illustrates a raised back, side perspective view of an exemplary embodiment of the apparatus for positioning a mobility device of FIG. 33A according to aspects of the present disclosure.

DETAILED DESCRIPTION OF THE INVENTION

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Figure 1:
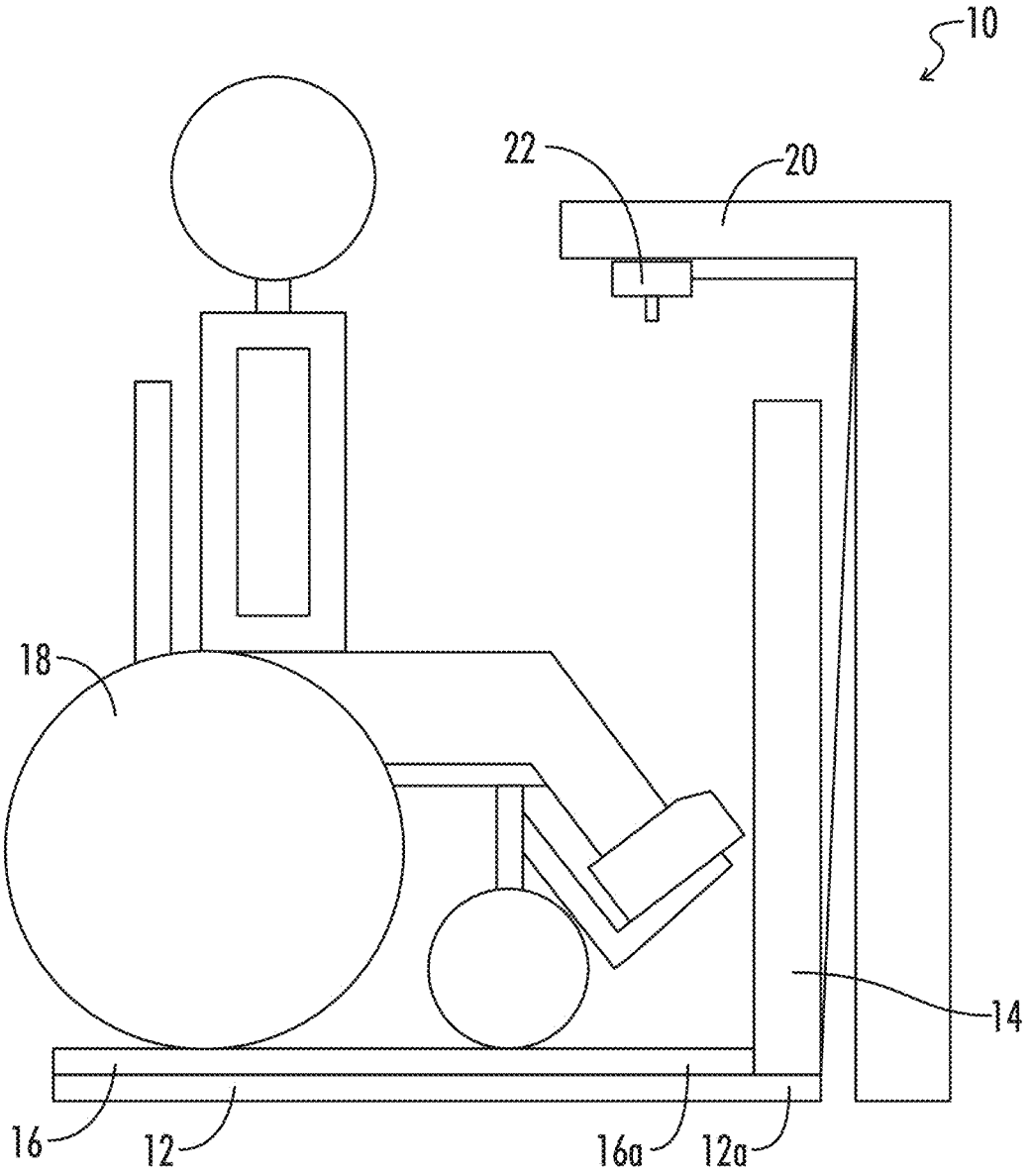
FIG. 1 illustrates a side view of a partial block diagram of an exemplary embodiment of a lifting apparatus in a lowered position according to aspects of the present disclosure.
Figure 2:
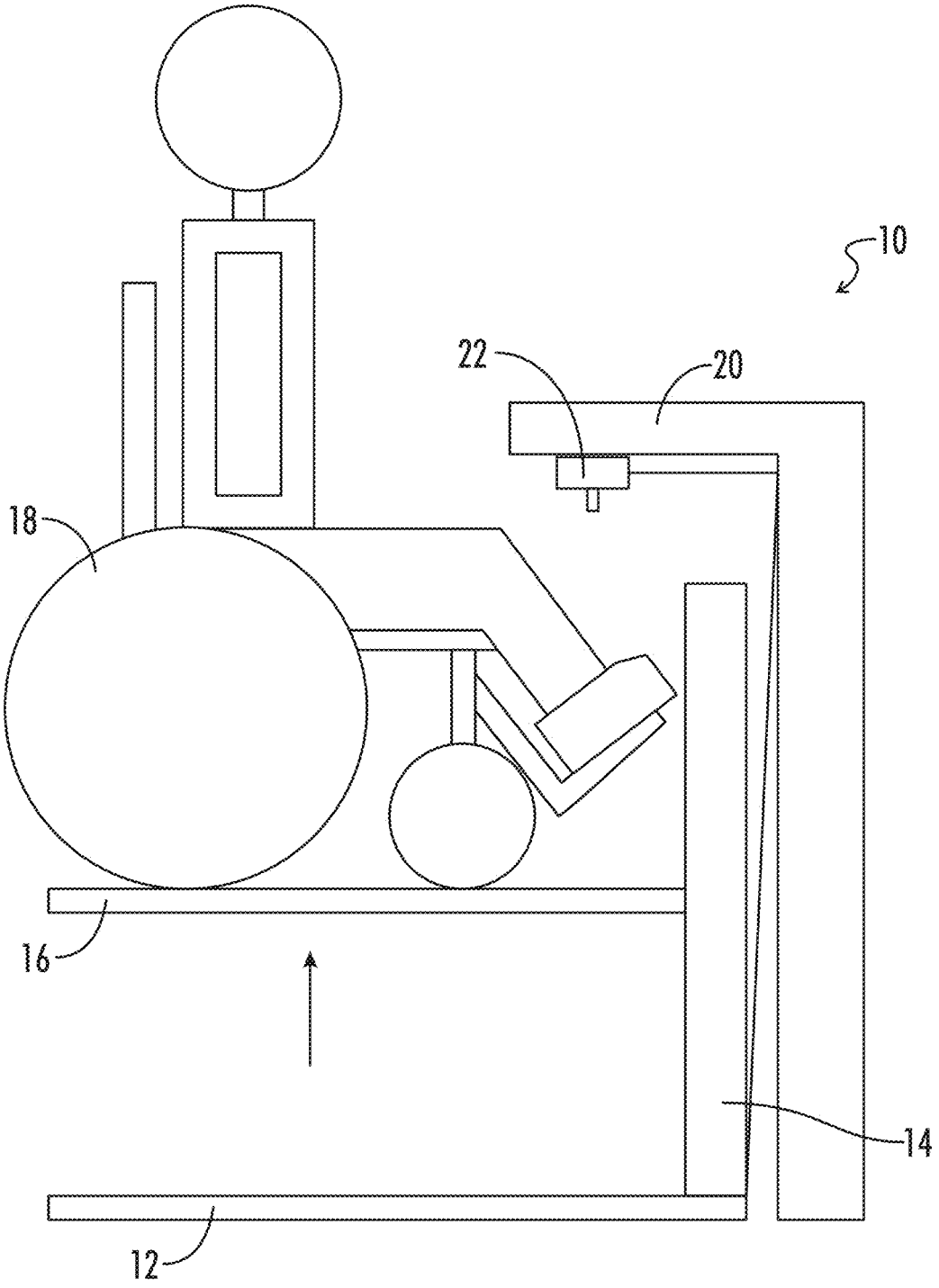
FIG. 2 illustrates a side view of a partial block diagram of the exemplary embodiment of the lifting apparatus of FIG. 1 in a raised position according to aspects of the present disclosure.

One embodiment of a wheelchair lift apparatus 10 of the present disclosure is shown in FIGS. 1-2. Apparatus 10 can include a base support frame 12, a lift 14 mounted to base support frame 12, and a wheelchair platform 16 coupled to lift 14. Lift 16 can be operable to selectively move wheelchair platform 16 vertically between a lowered position, shown in FIG. 1, and a raised position shown in FIG. 2. Apparatus 10 can be positionable under a bar, counter, table, etc. or other raised structure 20. Apparatus 10 can be configured such that wheelchair platform 16 can be lifted vertically without raised structure 20 interfering with the movement of either lift 14 or wheelchair platform 16. As such, a user in a wheelchair 18 can roll onto wheelchair platform 16, and lift 14 can be actuated to raise the user in wheelchair 18 vertically. The height of a user above the floor when wheelchair platform 16 is in the raised position as shown in FIG. 2 can correspond to the same level or height of a non-wheelchair user either sitting or standing at or near the raised structure 20. For instance, in a bar setting, when wheelchair platform 16 is in the raised position, a user in a wheelchair 18 on wheelchair platform 16 can generally be at the same height and vertical position as another non-wheelchair customer sitting on a barstool or standing at the bar.

In some embodiments, lift 14 can be mounted to a front end 12*a* of base support frame 12, and a front end 16*a* of wheelchair platform 16 can be coupled to lift 14. Lift 14 can generally be positioned under raised structure 20 and wheelchair platform 16 can extend laterally from lift 14. As such, when wheelchair platform 16 is in the lowered position, wheelchair platform 16 and base support frame 12 can extend out from the raised structure 20 at a position close to the floor or ground while lift 14 can be contained below raised structure 20, giving apparatus 10 a relatively small footprint when the apparatus 10 is not being utilized to lift a person in a wheelchair. Thus, the space where the apparatus 10 and particularly wheelchair platform 16 is located can also be utilized by non-wheelchair patrons with relative ease. For instance, a bar stool or high chair can be readily placed on wheelchair platform 16 such that the space occupied by apparatus 10 can also be utilized and commercialized for instance at a bar or restaurant when the apparatus 10 is not being used to lift a patron in a wheelchair.

In some embodiments, as shown in FIG. 2, lift 14 can include a linear vertical lift, such as a jack screw or linear actuator, which can selectively move wheelchair platform 16 vertically. In other embodiments, lift 14 can include a hydraulic or pneumatically powered vertical lift which can selectively raise wheelchair platform 16 vertically. In some embodiments, one or more threaded screws on lift 14 can extend through wheelchair platform 16 and engage corresponding threaded apertures defined in wheelchair platform 16. As the threaded screws on lift 14 are rotated, wheelchair platform 16 can translate vertically with respect to lift 14, wheelchair platform 16 moving in opposing directions as jack screws rotate in opposing directions. In some embodiments, lift 14 can be powered by one or more electric motors. In some embodiments, platform 16 can be cantilevered from lift 14 as platform moves away from base support frame 12.

Apparatus 10 can include a switch or remote 22 for actuating lift 14, the motor and/or motors of the lift being coupled to remote 22. In some embodiments, remote 22 can be positionable on or under raised structure 20 such that as a user in wheelchair 18 rolls onto wheelchair platform 16, remote 22 can be readily accessible by the user. In other embodiments, remote 22 can be positioned on lift 14, wheelchair platform 16, or some other component of apparatus 10. Remote 22 could also be wireless and/or implement one or more wireless communication protocols for controlling at least a portion of the apparatus 10.

Figure 3:
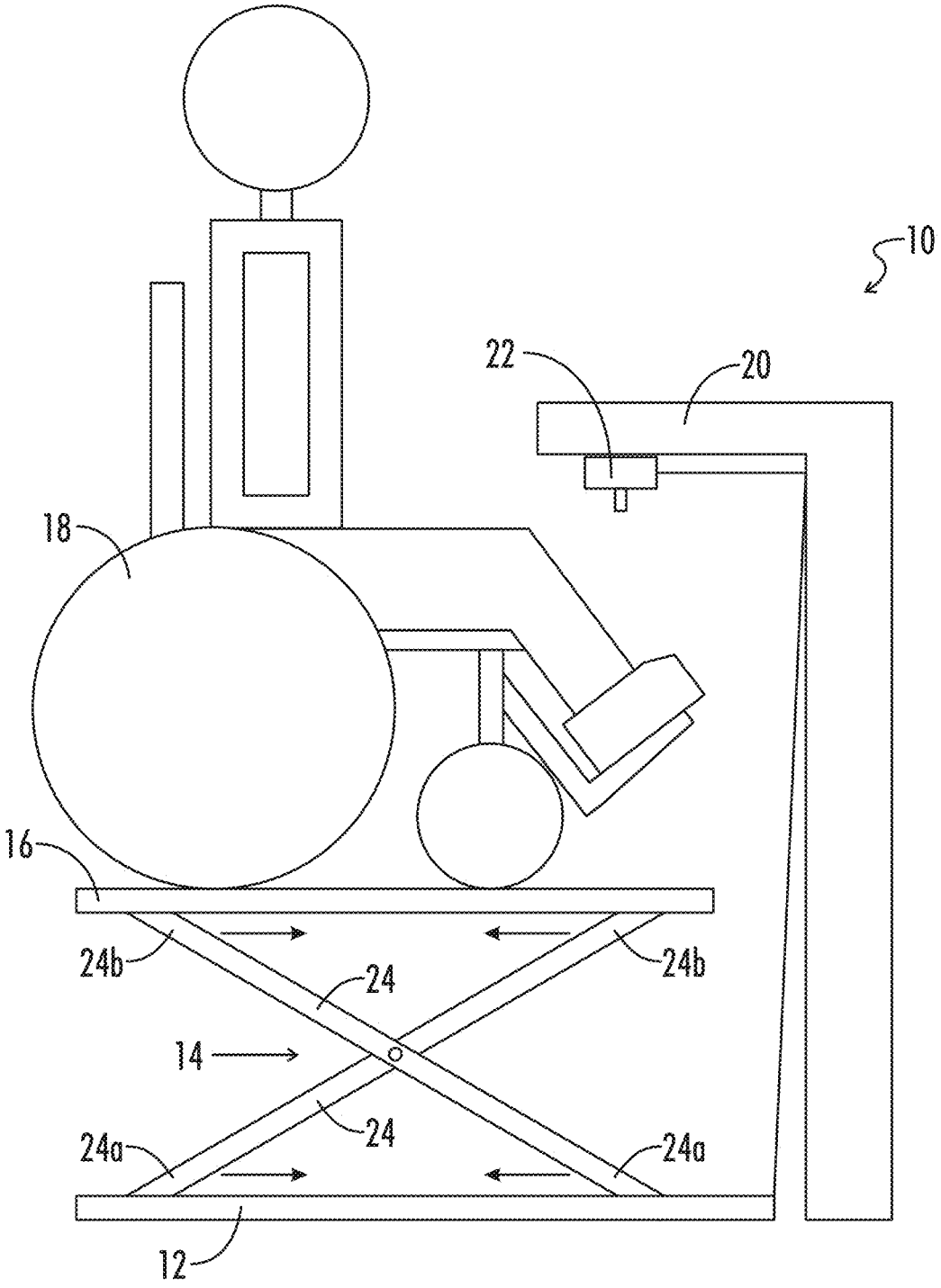
FIG. 3 illustrates a side view of a partial block diagram of an alternative exemplary embodiment of the lifting apparatus of FIG. 1 implementing a scissor lift according to aspects of the present disclosure.

In some embodiments, as shown in FIG. 3, lift 14 can include a scissor lift positioned beneath wheelchair platform 16. Scissor lift 14 can include multiple scissor legs 24 pivotally connected together. In a lowered position scissor legs 24 can collapse upon one another such that wheelchair platform 16 is positioned near or on base support frame 12. Either lower ends 24*a* or upper ends 24*b* of scissor legs 24 can be selectively forced toward one another to produce a scissoring action of scissor legs 24 to force wheelchair platform 16 in an upward direction. In some embodiments, movement of scissor legs 24 can be powered by a motor. Such a configuration having a scissor lift can help further reduce the footprint of apparatus 10 as lift 14 is contained under wheelchair platform 16 which when in a lowered position can still be contained in a position relatively close to the floor or ground. In some embodiments, lift 14 can include multiple pairs of scissor legs, each side of wheelchair platform 16 being supported by one or more corresponding pairs of scissor legs.

Figure 4:
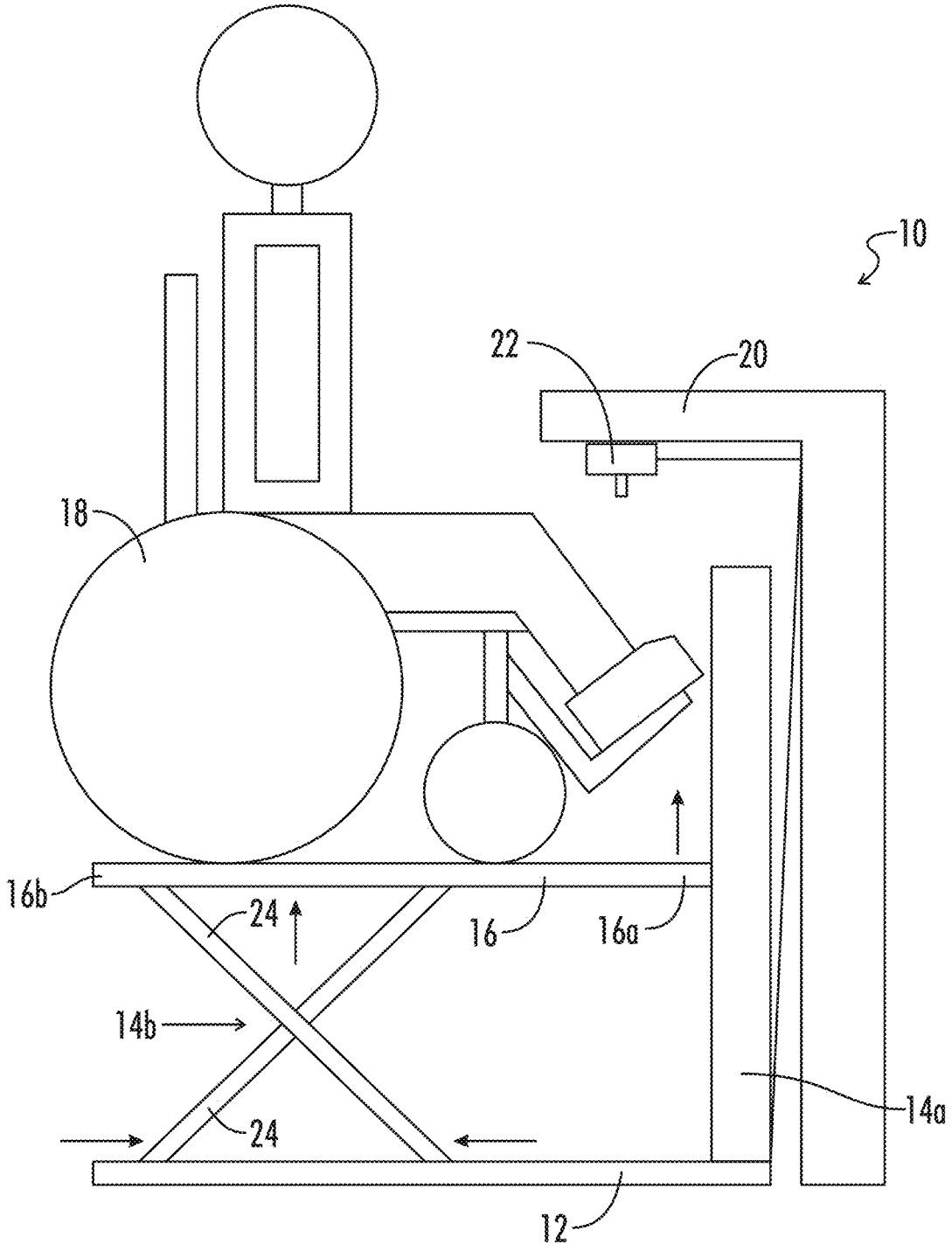
FIG. 4 illustrates a side view of a partial block diagram of an alternative exemplary embodiment of the lifting apparatus of FIG. 1 implementing multiple lift mechanisms according to aspects of the present disclosure.

In other embodiments, as shown in FIG. 4, lift 14 can include a first lift device 14*a* and a second lift device 14*b*. First lift device 14*a* can be a vertical lift such as a jack screw style lift coupled to and supporting a front end 16*a* of platform 16. Second lift device 14*b* can be a scissor lift with multiple scissor legs 24 positioned beneath a rear end 16*b* of wheelchair platform 16. As such, wheelchair platform 16 can be supported by lift device 14*a* and 14*b* at both a front end 16*a* and back end 16*b* respectively. First lift device 14*a* and second lift device 14*b* can be configured or programmed when operated to vertically move front end 16*a* and back end 16*b* respectively of wheelchair platform 16 at equal rates such that wheelchair platform 16 can remain level with a floor or ground as wheelchair platform 16 is lifted by first and second lifting devices 14*a* and 14*b*.

Figure 5:
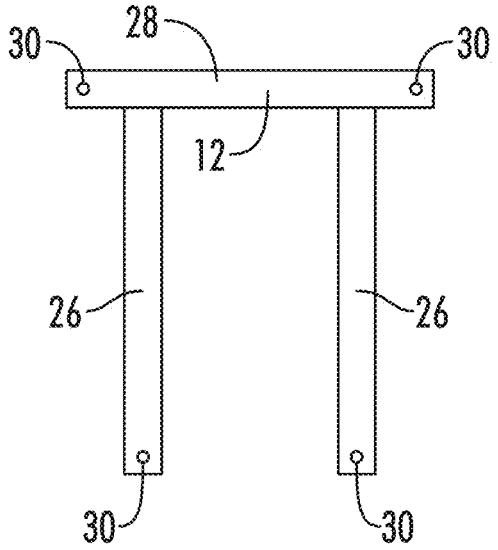
FIG. 5 illustrates a top view of an exemplary embodiment of a base support frame according to aspects of the present disclosure.

In some embodiments, as shown in FIG. 5, base support frame 12 can include lateral rails 26 and a cross bar 28 to form an H-shaped frame. Lateral rails 26 and cross bar 28 can include a plurality of bolt or screw holes 30 such that set screws or bolts can be inserted through holes 30 and into the floor or ground beneath base support frame 12 to secure base support frame 12 and apparatus 10 in a desired position under the raised structure. The set screws or bolts can help prevent unwanted motion of apparatus 10 during operation of apparatus 10. In some embodiments, base support frame 12 can be mounted under a raised structure such that cross bar 28 is positioned beneath the raised structure. In some embodiments including a vertical lift and a scissor lift, the vertical lift can be supported by cross bar 28 and the scissor lift can be supported by side rails 26. Side rails 26 in some embodiments can include scissor lift guide tracks on or in which lower ends of the scissor legs of the scissor lift can be positioned, the lower ends of the scissor legs movable along the guide tracks on side rails 16.

Figure 11:
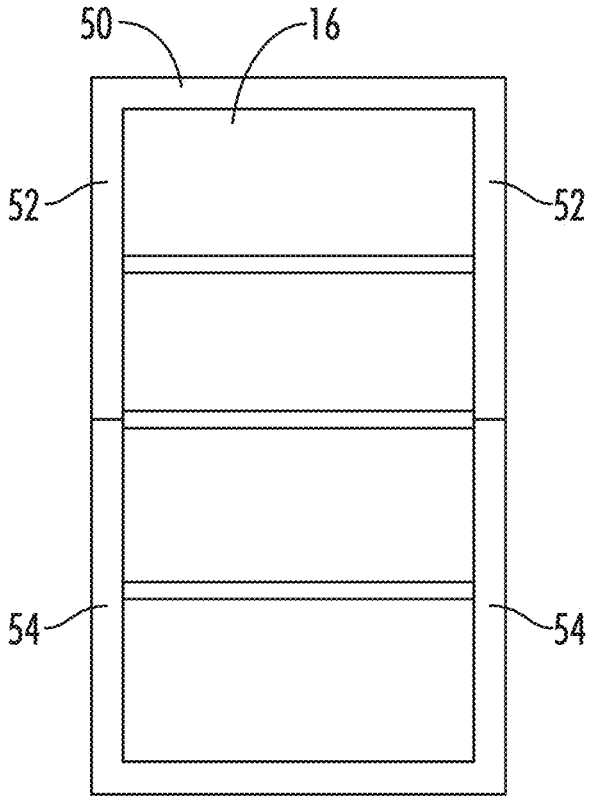
FIG. 11 illustrates a top view of an exemplary embodiment of a wheelchair platform supported by a scissor lift according to aspects of the present disclosure.

In some embodiments including a scissor lift, an under side of wheelchair platform 16 can include a platform support frame 50 including side support rails 52, as shown in FIG. 11. In those embodiments including a scissor lift, side support rails 52 of platform support frame 50 can include scissor lift guide tracks 54 corresponding to the scissor lift guide tracks on the side rails of the base support frame. Upper ends of the scissor legs of the scissor lift can be positioned in or on the scissor lift guide tracks 54 on the side support rails 52 of the platform support frame 50. As such, in some embodiments, lower ends of scissor lift legs 24 can be positioned in scissor lift guide tracks on the base support frame and upper ends of the scissor lift legs can be positioned in scissor lift guide tracks on the side rails 54 of the platform support frame 50. At least one of the ends of the scissors legs positioned on or in each guide track on the base support frame and the platform support frame 50 can be movable on or in the guide tracks such that the ends of the scissor lift legs can be selectively moved toward and away from each other to produce a scissoring motion that can move the scissor lift in an upward or downward direction to move wheelchair platform 16.

Figure 6:
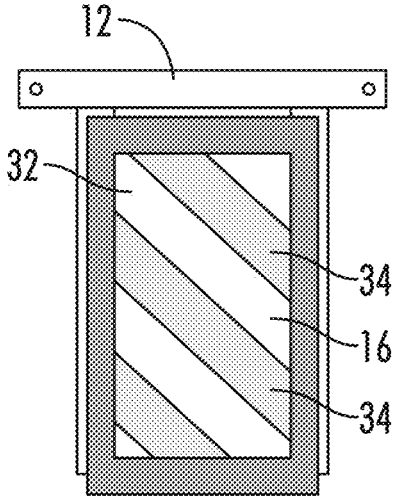
FIG. 6 illustrates a top view of the exemplary embodiment of the base support frame of FIG. 5 including an upper surface including one or more textured portion according to aspects of the present disclosure.

In some embodiments, as shown in FIG. 6, wheelchair platform 16 can include an upper surface 32 which can have one or more textured portions 34. The textured portions 34 on wheelchair platform 16 can help produce friction between wheelchair platform 16 and the wheels of a wheelchair positioned on wheelchair platform 16 to help reduce unwanted movement of the wheelchair on wheelchair platform 16. The one or more textured portions 34 of wheelchair platform 16 can be made from non-skid or textured materials including but not limited to, sand paper material, fabrics, rubber matting, etc.

Figure 8:
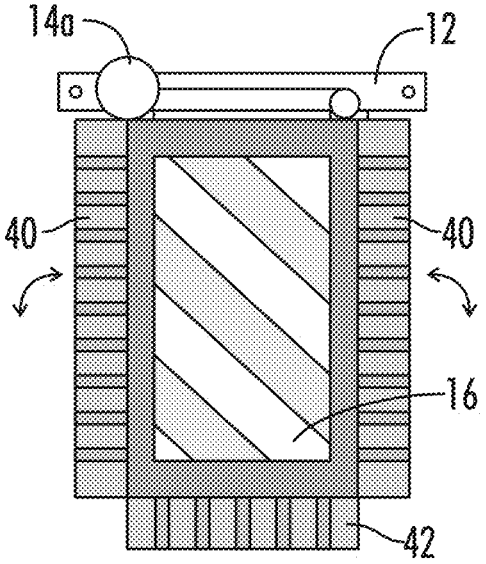
FIG. 8 illustrates a top view of the exemplary embodiment of the base support frame of FIG. 5 including one or more lateral side flaps and a rear ramp according to aspects of the present disclosure.

In some embodiments, as shown in FIG. 8, wheelchair platform 16 can include one or more lateral side flaps 40, and a rear ramp 42. Lateral side flaps 40 and rear ramp 42 can be pivotally connected to wheelchair platform 16 and configured to rotate between a raised position and a lowered position. When a wheelchair is positioned on wheelchair platform 16 and side flaps 40 and rear ramp 42 are in a raised position, side flaps 40 and rear ramp 42 can partially enclose the wheelchair and help prevent the wheelchair from falling off of wheelchair platform 16, thereby helping to increase the safety of apparatus 10. When side flaps 40 and rear ramp 42 are in a lower position and wheelchair platform 16 is in a lowered position on apparatus 10 near the floor or ground, side flaps and rear ramp 42 can be rotated to rest on the floor or ground or to be flush with the floor or ground which can help provide a smooth transition between the floor or ground and the slightly elevated wheelchair platform 16. In some embodiments, the wheelchair platform 16 can also be flush with the ground when in a lowered position. Side flaps 40 and rear ramp 42 can also provide one or more ramps onto wheelchair platform 16 which can help a user roll up onto wheelchair platform 16 in a wheelchair smoothly. Side flaps 40 and rear ramp 42 can also help reduce any tripping hazard with respect to wheelchair platform 16 when wheelchair platform 16 is in the lowered position as side flaps and rear ramp can help produce a smoother transition between the floor and wheelchair platform 16.

Figure 12:
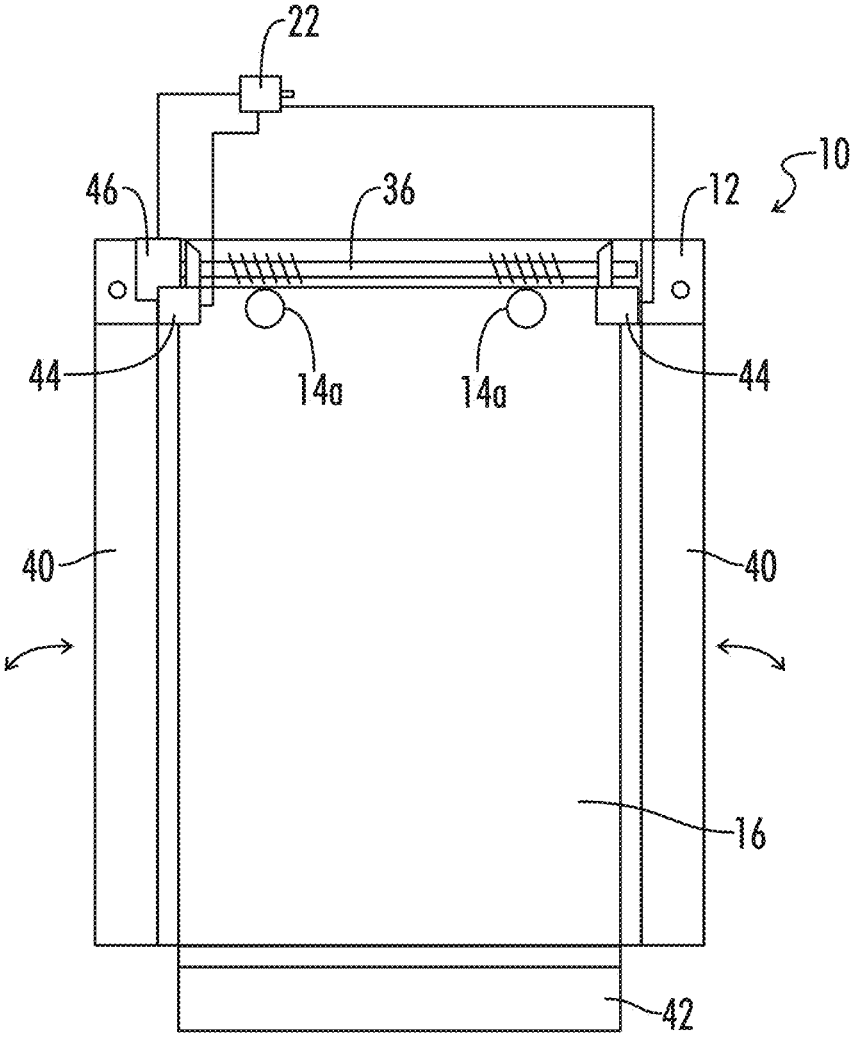
FIG. 12 illustrates a top view of an exemplary embodiment of the base support frame of FIG. 5 including a drive motor according to aspects of the present disclosure

In some embodiments, side flaps 40 and rear ramp 42 can be manually rotated between a raised and a lowered position. Side flaps 40 and rear ramp 42 can be selectively secured manually with one or more locking features in a raised position around a user in a wheelchair on wheelchair platform 16 to help secure and partially enclose the user on wheelchair platform 16. In other embodiments, as shown in FIG. 12, side flaps and rear ramp 42 can be coupled to one or more corresponding motors 44 which can be electrically communicated with remote 22 of the apparatus 10. As such, both the drive motor 46 for the lift 14 and the motor(s) 44 for the side flaps 40 and rear ramp 42 can be in electronic communication with remote 22. As such, when a user actuates remote 22 to cause lift 14 to lift wheelchair platform 16 in an upward direction, remote 22 can simultaneously cause motors 44 to rotate side flaps 40 and rear ramps 42 to a raised position. In some embodiments, remote 22 can be programmed to raise side flaps and rear ramp 42 prior to lifting wheelchair platform 16, though both functions are controlled from a singular input or switch on remote 22. In other embodiments, side flaps 40 and rear ramp 42 can be controlled separately from lift 14 such that a user can raise side flaps 40 and rear ramp 42 once the user is positioned on wheelchair platform 16 before actuating lift 14 to raise the wheelchair platform. In some embodiments, motors 44 for the side flaps 40 and rear ramp 42 can include one or more limit switches such that rotation of side flaps 40 and rear ramp 42 can be stopped when a certain position is reached, even if remote 22 remains actuated, such that the rotation of flaps 40 and ramp 42 can be limited as desired.

In some embodiments, motors 44 for side flaps 40 can be positioned on a front end 16*a* of platform 16 and a motor for the rear ramp 42 can be positioned beneath platform 16 such that the motors 44 for side flaps 40 and rear ramp 42 are generally out of the way of a user in a wheelchair rolling onto wheelchair platform 16, which can help prevent damage to the motors.

Figure 7:
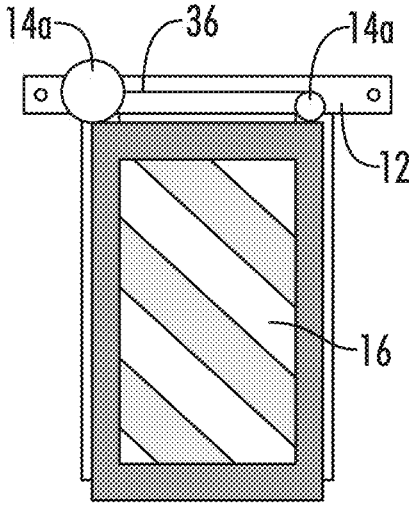
FIG. 7 illustrates a top view of the exemplary embodiment of the base support frame of FIG. 5 including two or more vertical screws according to aspects of the present disclosure.

In some embodiments, as shown in FIGS. 7 and 12, lift 14 can include two or more vertical lift screws 14*a* threadingly coupled to wheelchair platform 16. In some embodiments, multiple lift screws 14*a* can be driven by a single drive motor 46. In some embodiments, a lift screw axle or drive shaft 36 can engage multiple lift screws 14*a*. Lift screw axle 36 can be coupled to drive motor 46 such that multiple lift screws can be driven by drive motor 46. While FIGS. 7 and 12 illustrates lift screws 14*a* being driven by an axle 36 which can be rotated by a drive motor 46, there are many suitable configurations for simultaneously driving multiple lift screws 14*a*. For instance, in some embodiments, lift 14 can include a belt and pulley system disposed about and engaged with lift screws 14*a*. A motor can drive the belt and pulley system to simultaneously rotate lift screws 14*a*. In other embodiments, a motorized gear system can be coupled to lift screws 14*a* and the gear system can be driven to simultaneously rotate lift screws 14*a*.

Figure 9:
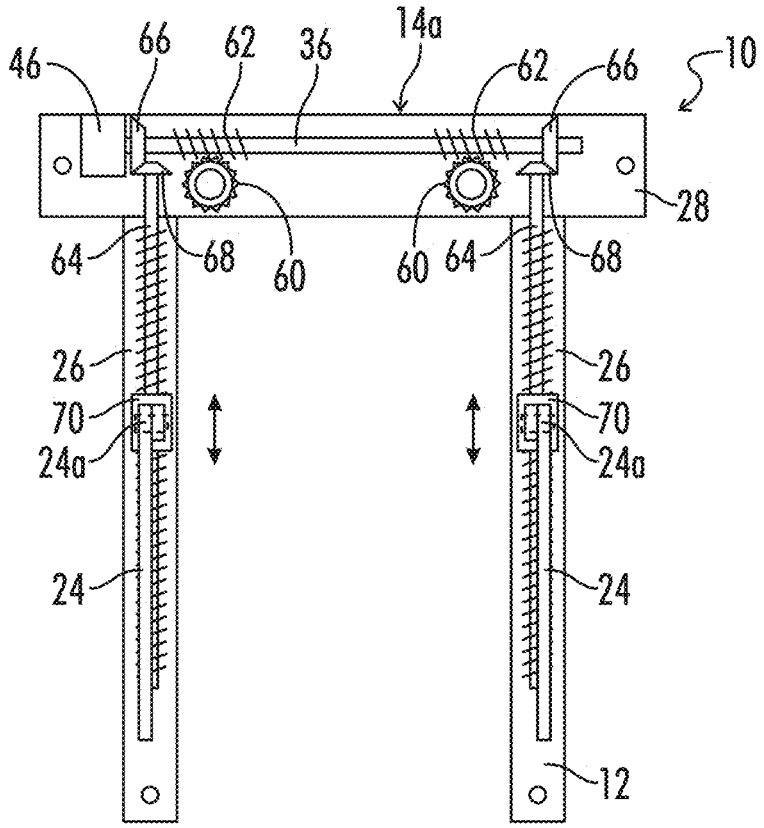
FIG. 9 illustrates a top view of an exemplary embodiment of first and second lift devices powered by a single motor or drive mechanism according to aspects of the present disclosure.
Figure 10:
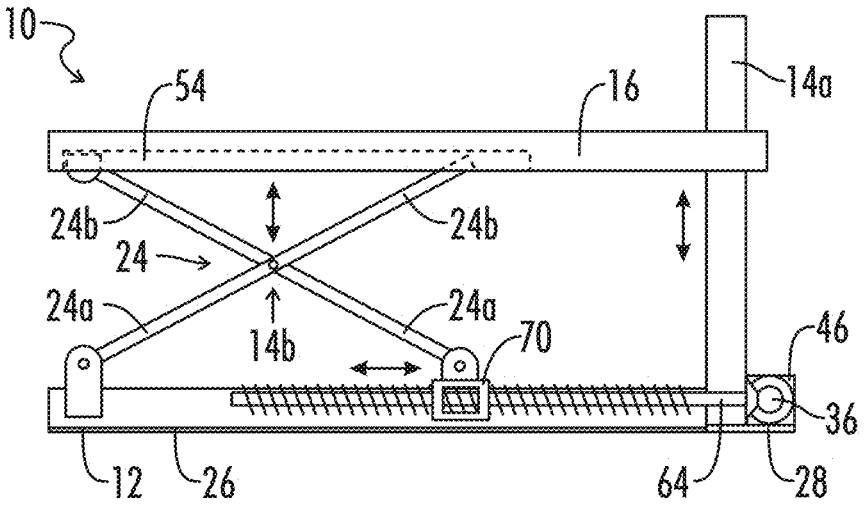
FIG. 10 illustrates a side view of the exemplary embodiment of the first and second lift devices powered by a single motor or drive mechanism of FIG. 9 according to aspects of the present disclosure.

In some embodiments, as shown in FIGS. 9 and 10, first lift device 14*a* and second lift device 14*b* can be powered by a single motor or drive mechanism. For instance, in some embodiments, drive motor 46 can include a drive shaft 36 which can be configured to rotate one or more lift screws on first lift device 14*a*. In FIG. 9, each lift screw on first lift device 14*a* can include a worm gear 60 which can be rotated by a corresponding threaded portion 62 of drive shaft 36 as drive motor 46 rotates drive shaft 36. As such, drive shaft 36 can rotate multiple lift screws of first lift device 14*a* simultaneously. Additionally, one or more scissor lift drive axles 64 can extend in a front to back direction and can generally be oriented substantially parallel to side rails 26 of base support frame 12. Drive shaft 36 can include one or more beveled gears 66, each beveled gear 66 meshing with a corresponding beveled gear 68 on one of the scissor lift drive axles 64. As such, as drive shaft 36 is rotated by drive motor 46, scissor lift drive axles 64 can be rotated to drive second lift device 14*b*. In some embodiments, scissor lift drive axles 64 can be threaded, and a lower end 24*a* of at least one scissor leg 24 can be connected to a scissor leg linear guide 70 which can be disposed on a corresponding threaded scissor lift drive axle 64. As scissor lift drive axle 64 is rotated by drive shaft 36 and drive motor 46, scissor leg guide 70 can translate linearly on scissor lift drive axle 64 to move a lower end 24*a* of a corresponding scissor leg 24 in a forward or rearward direction as desired toward or away from a lower end 24*a* of a second corresponding scissor leg 24 to either raise or lower the scissor lift 14*b* and wheelchair platform 16. While one mechanism is shown for simultaneously operating both a first vertical lift device 14*a* and a second scissor lift device 14*b* in FIGS. 9-10, it will be readily understood that a variety of different configurations including but not limited to axle systems, gear systems, belt and pulley systems, or any combination thereof can be utilized to simultaneously drive both first and second lift devices 14*a* and 14*b*. In other embodiments, a single motor can be coupled directly to one or more screw lift axles and scissor lift drive axles such that the motor turns multiple axles simultaneously.

Figure 13:
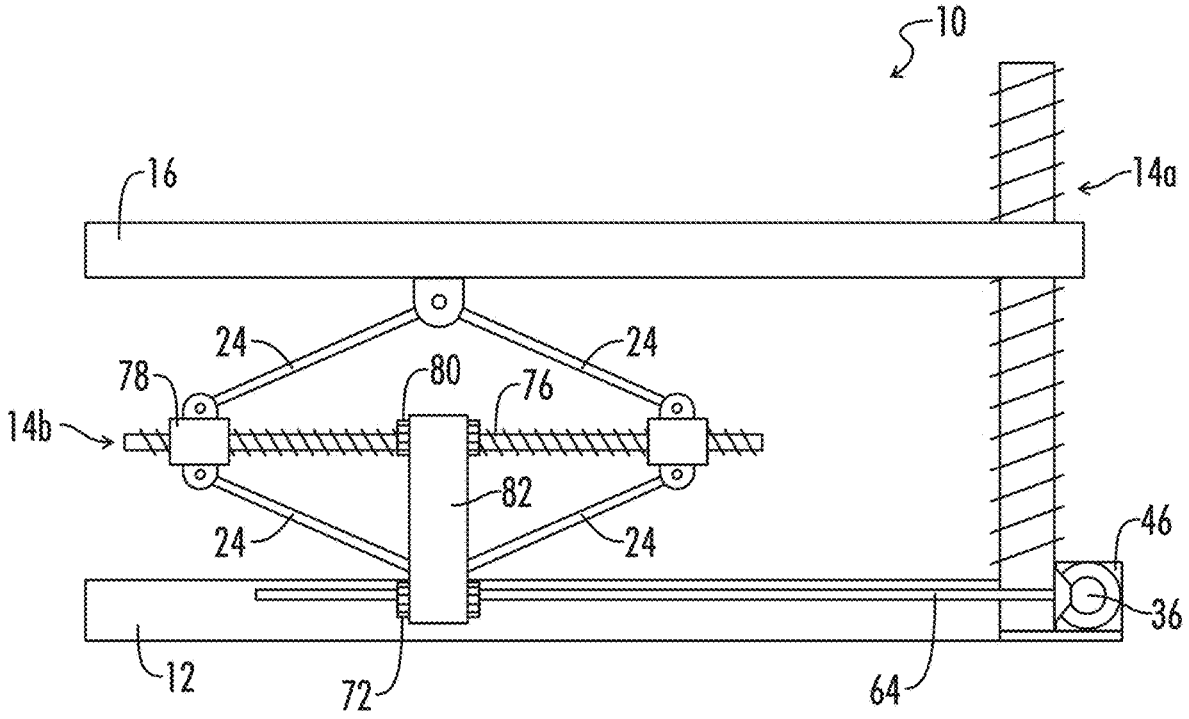
FIG. 13 illustrates a side view of an exemplary embodiment of a lifting mechanism having a scissor lift driving axel according to aspects of the present disclosure.
Figure 14:
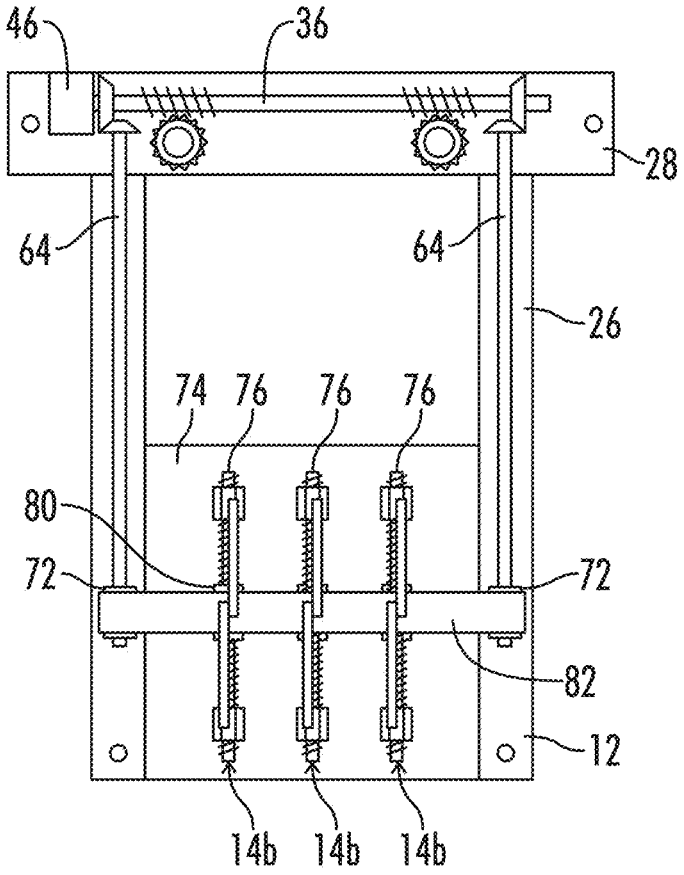
FIG. 14 illustrates a top view of an exemplary embodiment of a lifting mechanism having a plurality of scissor lifting mechanisms according to aspects of the present disclosure.

In some embodiments, as shown in FIGS. 13 and 14, scissor lift drive axles 64 can each include a gear grooved belt track 72. Second lift device 14*b* can include one or more scissor lift devices positioned between side rails 26 of base support frame 12 on a scissor lift support platform 74. Each scissor lift device 14*b* can include a scissor lift drive screw 76 coupled to scissor legs 24 on the scissor lift device. One or more scissor leg linear guides 78 can be disposed on the scissor lift drive screw 76 of a corresponding scissor lift device 14*b*. One or more of the scissor legs 24 of the lift device 14*b* can be pivotally connected to the scissor leg linear guide 78. As scissor lift drive screw 76 is rotated, scissor leg linear guide 78 translates on scissor lift drive screw 76 to actuate the scissor lift 14*b*. In some embodiments, scissor lift devices 14*b* can include two scissor leg linear guides 78 positioned on opposing ends of drive screw 76. Various scissor legs 24 can be connected to the scissor leg linear guides 78. As drive screw 76 rotates to force linear guides 78 toward one another, scissor lift 14*b* can lift wheelchair platform 16 to a raised position, and as drive screw 76 rotates to move linear guides 78 away from one another, scissor lift 14*b* can lower wheelchair platform 16 to the lowered position. Each drive screw 76 can include a corresponding gear grooved belt track 80. A belt 82 can be coupled around gear grooved belt tracks 72 on scissor lift drive axles 64 and around corresponding gear grooved belt tracks 80 on drive screws 76 on each of the scissor lift devices 14*b*. As such, as drive motor 46 rotates scissor lift drive axles 64, belt 82 can rotate drive screws 76 via gear grooved belt tracks 80 on drive screws 76 to simultaneously operate multiple scissor lift devices 14*b* of the apparatus 10.

Figure 19:
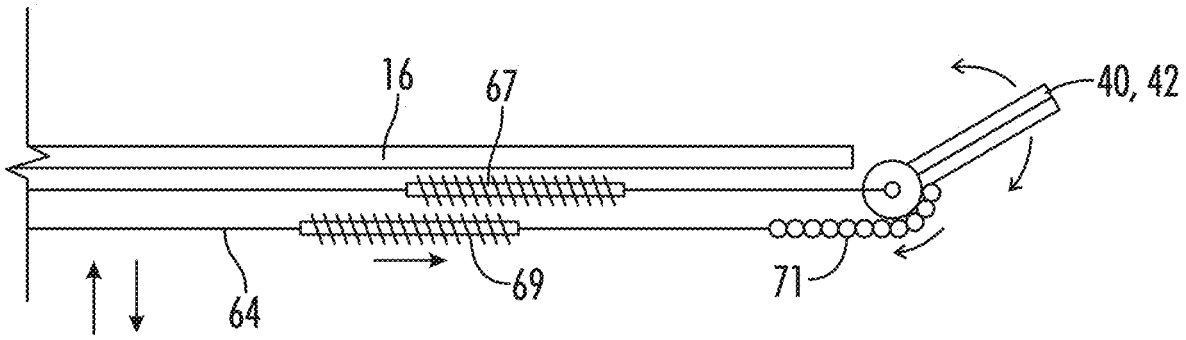
FIG. 19 illustrates a side view of an exemplary embodiment of a side flap and rear ramp drive assembly according to aspects of the present disclosure.

In some embodiments, as shown in FIG. 19, one or more of the side flaps 40 and/or rear ramp 42 can also be driven by a scissor lift drive axle 64, and thus by a drive motor 46 of the apparatus 10, depending on the position of wheelchair platform 16. A scissor screw 69 can be positioned on scissor lift drive axle 64 that can rotate as scissor lift drive axle 64 is rotated by the drive motor 46. A corresponding platform screw 67 can be positioned beneath wheelchair platform 16 which can engage the scissor screw 69 on scissor lift drive axle 64 when wheelchair platform 16 is generally positioned in the lowered position. When drive motor is actuated to lift platform 16, the screws can be configured such that the platform screw 67 on wheelchair platform 16 translates toward one of the side flaps or rear ramp. As the platform screw 67 moves toward one of the side flaps or rear ramp the platform screw 67 can engage a lever on the side flap or rear ramp which can rotate the side flap or rear ramp to the raised position as platform screw 67 continues to translate. Once the side flap or rear ramp is moved to the raised position and the lift continues to raise the wheelchair platform 16, the platform screw 67 can disengage from the scissor lift drive axle screw such that side flap or rear ramp is retained in the raised position via platform screw 67 and the lever on the side flap or rear ramp. As lift 14 subsequently lowers platform 16 to the lowered position and scissor lift drive axle 64 rotates in the opposite direction, the platform screw 67 can reengage the screw on the scissor lift drive axle 64 such that the scissor screw 69 on the scissor lift drive axle 64 can move the platform screw 67 away from the side flap or rear ramp such that the side flap or rear ramp can rotate back to the lowered position.

As such, the side flap or rear ramp lifting mechanism can lift the side flap or rear ramp to the raised position quickly as lift 14 raises wheelchair platform 16. As platform screw 67 disengages the scissor screw 69 on scissor lift drive axle 64 as wheelchair platform 16 is raised vertically, side flap or rear ramp can be retained in the raised positioned until wheelchair platform is returned to the lowered position and platform screw 67 reengages with the scissor screw 69 on scissor lift drive axle 64, generally at a lower and safer distance above the ground. Such a mechanism can allow for automated lifting of a side flap 40 or rear ramp 42 without the need for an additional motor. In some embodiments, a side flap 40 or rear ramp 42 can be biased in a lowered position, for instance via a spring 71, such that as wheelchair platform 16 is lowered to the lowered position, and the platform screw 67 moves away from the side flap or rear ramp, the side flap or rear ramp can be biased to return to the lowered position.

Figure 15:
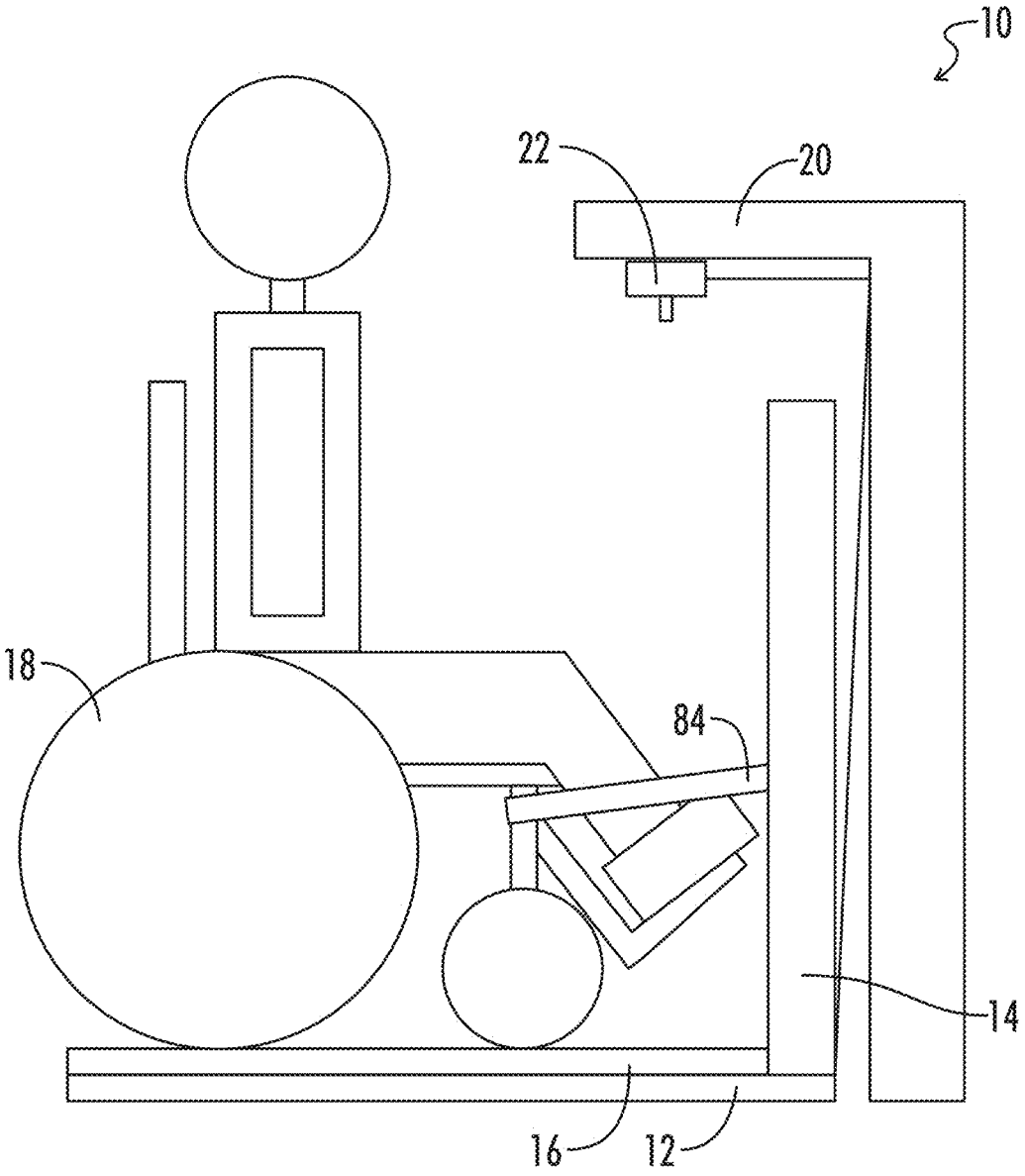
FIG. 15 illustrates a side view of a partial block diagram of an exemplary embodiment of a lifting apparatus having a one or more security straps according to aspects of the present disclosure.
Figure 16:
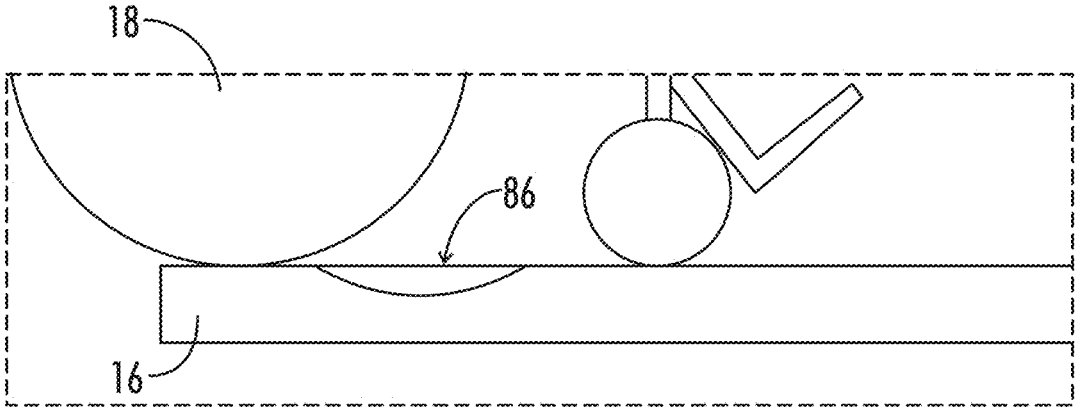
FIG. 16 illustrates a side view of a partial block diagram of an exemplary embodiment of a wheelchair restraint section according to aspects of the present disclosure.
Figure 17:
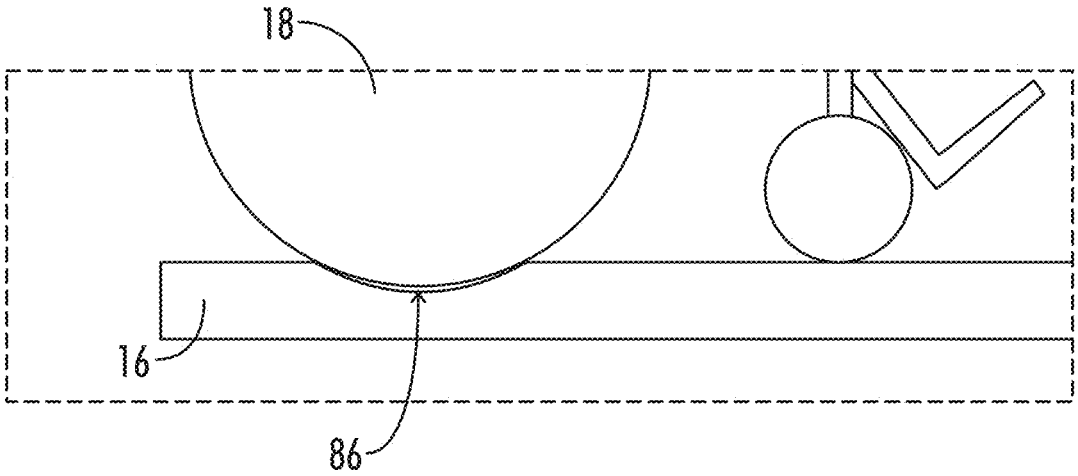
FIG. 17 illustrates a side view of a partial block diagram of the exemplary embodiment of the wheelchair restraint section of FIG. 16 securing a wheel of a wheelchair according to aspects of the present disclosure.

In some embodiments, as shown in FIGS. 15-17, apparatus 10 can include a variety of measures for securing or retaining a wheelchair 18 onto wheelchair platform 16. In some embodiments, as shown in FIG. 15, apparatus 10 can include one or more security straps 84 which can be wrapped around at least a portion of a wheelchair 18 at one or more various locations in order to secure wheelchair 18 on wheelchair platform 16. In some embodiments, one or more security straps 84 can be connected to one or more or the lift 14 or wheelchair platform 16 and can be readily accessible by a user in a wheelchair 18 positioned on wheelchair platform 16.

In some embodiments, as shown in FIGS. 16-17, wheelchair platform 16 can include one or more wheel retention channels 86 defined in an upper surface of wheelchair platform 16. As a wheelchair 18 is rolled onto wheelchair platform 16, one or more of the wheels of the wheelchair 18 can be positioned in a corresponding wheel retention channel 86. In some embodiments, wheelchair retention channel 86 can have a rounded profile which can conform to the shape of a wheel of wheelchair 18 to provide a smooth contact between wheel retention channel 86 and a wheel of wheelchair 18. A wheel of wheelchair 18 can rest down in wheel retention channel 86 such that wheel retention channel 86 can help prevent forward and backward motion of the wheel 18 such that wheel retention channel 86 acts as a wheel block for wheelchair 18. In some embodiments, wheel retention channel 86 can have a width that is slightly larger than the width of a wheel such that a wheel when positioned in wheel retention channel 86 fits somewhat snugly in wheel retention channel 86 such that wheel retention channel 86 can help prevent lateral movement as well as forward and back movement of wheelchair 18 on wheelchair platform 16.

In some embodiments, wheelchair platform 16 can include a wheel retention aperture (not illustrated) extending through wheelchair platform 16. Apparatus 10 can also include a support plug (not illustrated) which can be mounted to the base support frame to plug the wheel retention aperture or wheel retention channel 86 when wheelchair platform 16 is in the lowered position. In some embodiments, as wheelchair platform 16 is lifted, the support plug can remain in a fixed position such that support plug is removed from the wheel retention aperture as wheelchair platform 16 is lifted. As such, when a wheel of the wheelchair 18 is positioned over wheel retention aperture and on the support plug when wheelchair platform 16 is in the lowered position, and wheelchair platform 16 is subsequently lifted, the wheel of the wheelchair 18 can fall into wheel retention aperture as a support plug is removed to retain the wheelchair 18 in a desired position on wheelchair platform 16. When the wheelchair platform 16 is subsequently lowered, the support plug can be reinserted into wheel retention aperture and can effectively lift the wheel of wheelchair 18 out of the wheel retention aperture such that a user can easily roll wheelchair 18 off wheelchair platform 16.

In some embodiments, apparatus 10 can include one or more locking hooks (not illustrated) that can selectively engage wheelchair 18 when wheelchair 18 is positioned on wheelchair lift 16. In some embodiments, locking hooks can be configured to automatically engage wheelchair 18 as wheelchair 18 is rolled onto wheelchair platform 16.

In some embodiments, the remote for apparatus 10 can include a security assurance button or feature which a user can activate once a user is positioned on wheelchair platform 16 and the security measures are implemented. The remote 22 can be configured or programmed to not allow lift 14 to be engaged until the security assurance button or feature has been activated by a user. In other embodiments, security measures can be communicated with the remote 22 such that the remote can monitor the condition of the security measures via one or more sensors and not allow lift 14 to be raised until security measures are properly implemented.

In some embodiments, the base support frame 12 can include a plurality of wheels such that the apparatus 10 can be selectively relocated and stored, for instance when not in use, such that the area previously occupied by the apparatus 10 can be utilized in a traditional fashion. In some embodiments, the wheels can selectively retract into the base support frame such that the base support frame can rest flat on a floor or ground during use to help prevent unwanted motion of the apparatus 10.

Figure 18:
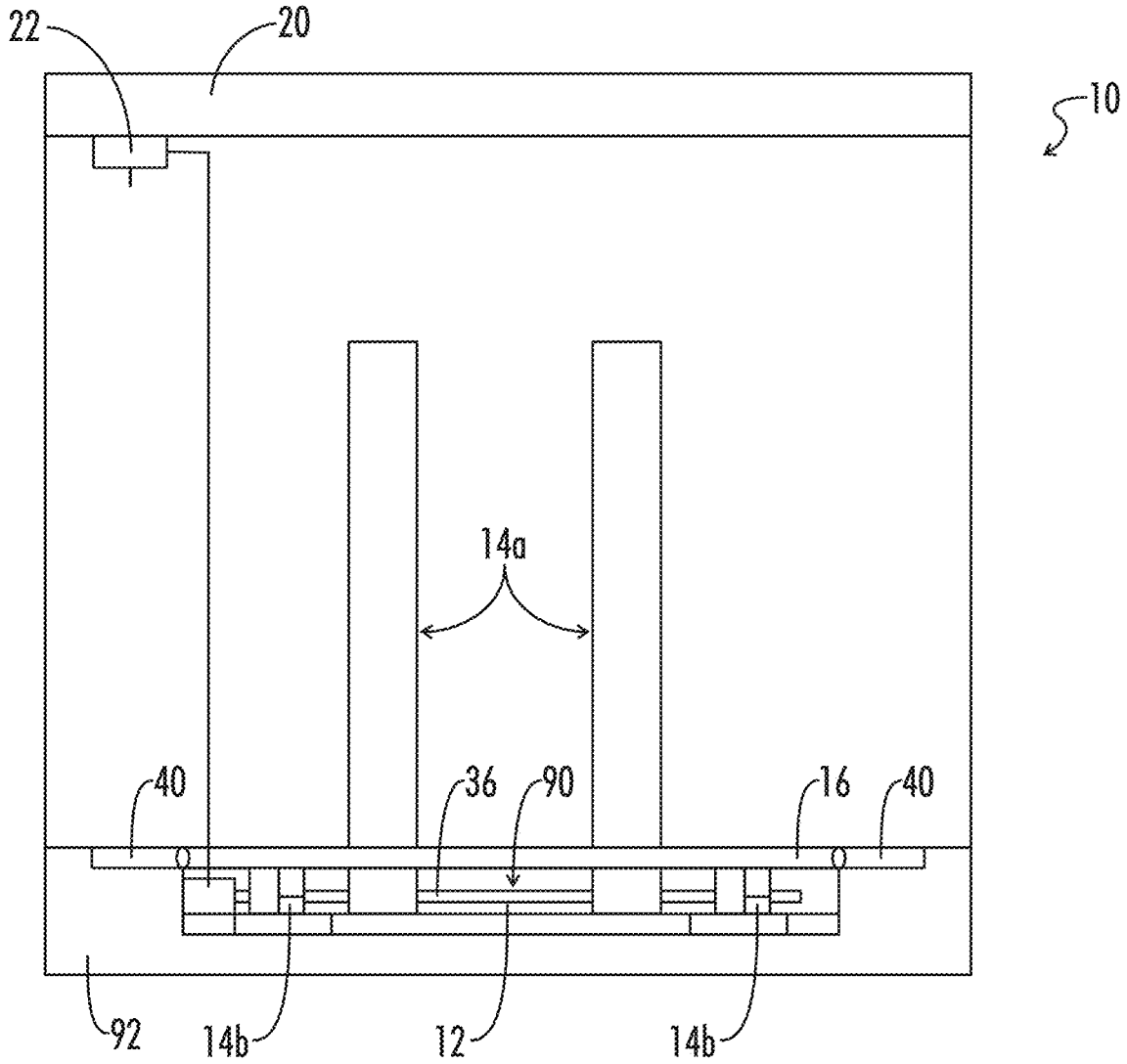
FIG. 18 illustrates a side view of an exemplary embodiment of a built in wheelchair lift according to aspects of the present disclosure.

In some embodiments, buildings having raised seating or standing structures such as bars, high top tables, high counters, etc. can include built in wheelchair lifts, as shown in FIG. 18. In such embodiments, a recess 90 can be defined in a floor 92 of the building beneath the raised structure 20. Base support frame 12 and at least some of the components of a lift 14 can be positioned within recess 90 and configured such that when wheelchair platform 16 is in the lowered position, wheelchair platform 16 is at a height and orientation that is parallel with the floor 92. As such, when wheelchair platform 16 is in the lowered position, wheelchair platform 16 acts as an extension of floor 92 such that the footprint and impact of apparatus 10 in the desired area when the apparatus 10 is not in use is greatly reduced. In some embodiments, side flaps 40 and rear flaps 42 could also be received into recess 90 of floor 92 and be maintained in an orientation parallel to floor 92 when wheelchair platform is in a lowered position, the side and rear flaps 40, 42 moving to an upward position as lift 14 moves wheelchair platform 16 upward as previously described. In some embodiments, a lift 14 can include a hydraulic, pneumatic, or scissor lift which can be completely retained within recess 90 when wheelchair platform 16 is in the lowered position such that when the apparatus 10 is not in use there is virtually no spaced occupied above floor 92 by the apparatus 10.

In other embodiments, the lift 14 can be a shelf style apparatus that can be built into a raised structure such as a bar or counter itself. The lift 14 can be pulled out from a bottom portion of the raised structure when needed, and can subsequently be returned to a stowed position within the raised structure when not in use. Such a configuration can help reduce the footprint of the lift 14 when not being used by an individual in a wheelchair 18.

Another aspect of the present disclosure includes a mobile application plug-in for existing restaurant search and reservation platforms that would allow restaurants to advertise or indicate that they have wheelchair accessible lifts in their restaurant or bar. As such, individuals in a wheelchair could download the plug-ins for existing applications and be able to search for bars or restaurants that have wheelchair lifts as previously described, determine lifts that are available at particular bars or restaurants, and make a reservation for the apparatus 10 at a particular bar or restaurant. In some embodiments, the lift 14 can include a display or user interface that can interact with the mobile application such that when an individual in a wheelchair 18 uses the lift, they can indicate on the user interface that the lift is taken, which can be communicated with the mobile application such that the availability status of that lift on the mobile application can be updated accordingly. The present disclosure also includes an independent mobile application outside of current bar and restaurant mobile search platforms that can be tailored specifically to the availability of the apparatus 10 and reservations for use by individuals in wheelchairs.

FIGS. 20-32 illustrate exemplary embodiments of apparatuses 100 for lifting and positioning a mobility device. The apparatus 100 may include at least one of a support structure 102, a lifting mechanism 104, a platform support assembly 106, a platform 108, and/or a ramp 110.

A support structure 102 of the apparatus 100 may have a lower surface 112 that is supportable upon a ground surface. The support structure 102 has a length L, a width W, and a height H. The support structure 102 may be hollow and may have an upper portion 114 having an upper opening 116. In some embodiments, the at least one support structure 102 may have a lower opening 118 through the lower surface 112. In other embodiments, the at least one support structure 102 may have at least one side opening 120 through a side surface 122 of the support structure facing the platform 108. The support structure 102 may be formed of materials providing sufficient strength such as steel, aluminum, fiberglass composite, graphite composite, or any other material as known in the art. The support structure 102 may optionally include one or more materials and/or additional structures intended to provide sufficient strength, desired deflection characteristics, corrosion resistance, or other properties of interest.

The lifting mechanism 104 may be coupled internally or externally to the support structure 102. In the exemplary embodiment illustrated by FIG. 20, each lifting mechanism 104 is housed within a support structure 102 and is positioned parallel with the height H of the support structure 102. A position and/or arrangement of the lifting mechanism 104 vary in other embodiments (e.g., may be perpendicular to H, parallel to W, parallel to L, etc.). Each lifting mechanism 104 may include at least one of a fixed lower end 124 and a moveable upper end 126. The upper end 126 of the lifting mechanism 104 may be positioned proximate to the upper opening 116 of the support structure 102. In other embodiments, the upper end 126 of the lifting mechanism 104 may be positioned proximate the lower opening 118 or side opening 120 of the support structure 102. The lower end 124 of the lifting mechanism 104 may be rigidly attached to the support structure 102. As shown in the exemplary embodiment of FIG. 20, the support structure 102 may have two lifting mechanisms 104, however any number of lifting mechanisms 104 may be used, including just one, in various embodiments. The lifting mechanism 104 may be any type of lift configured to enable a movement between a first position and second position. The lifting mechanism 104 may be a scissor lift, a rigid chain actuator, a traveling nut actuator, a hydraulic actuator, an electro-mechanical actuator, a cylindrical linear electrical actuator, or any other means of conveyance. The lifting mechanism 104 may be powered mechanically, electrically, hydraulically, or any other power source capable of use.

Figure 20:
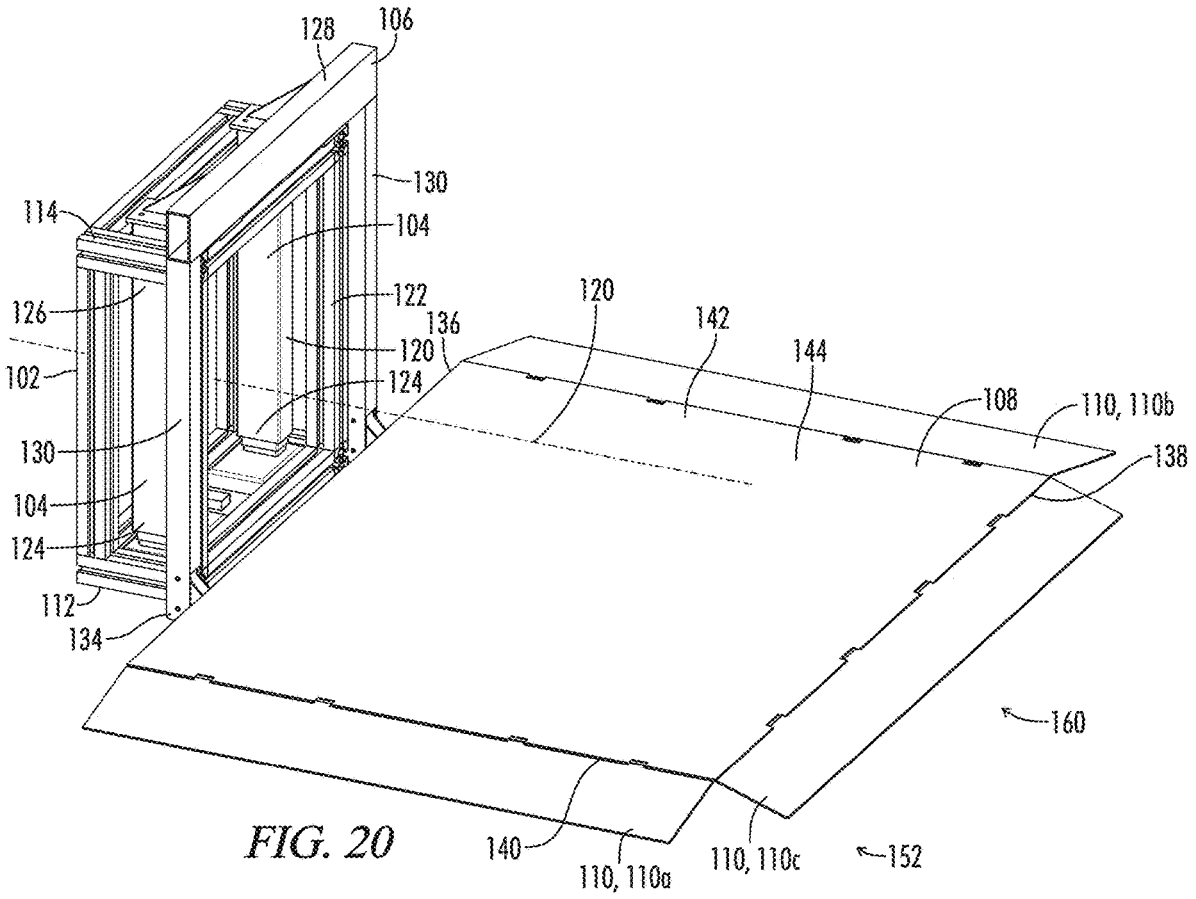
FIG. 20 illustrates a raised front, side perspective view of an exemplary embodiment of an apparatus for positioning a mobility device having a single support structure configuration according to aspects of the present disclosure.
Figure 21:
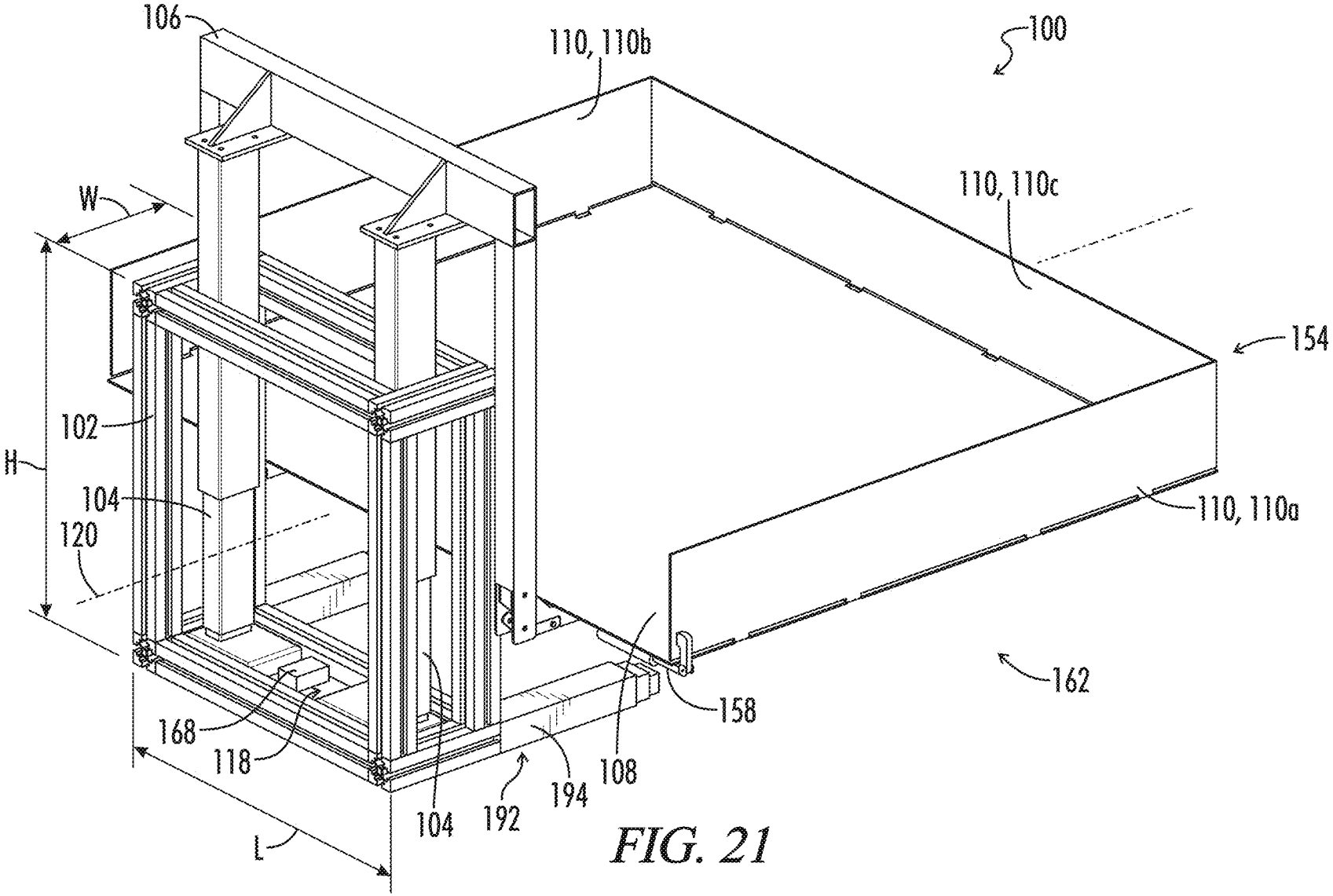
FIG. 21 illustrates a raised front, side perspective view of an exemplary embodiment of the apparatus for positioning a mobility device of FIG. 20 in a lifted platform configuration according to aspects of the present disclosure.
Figure 22:
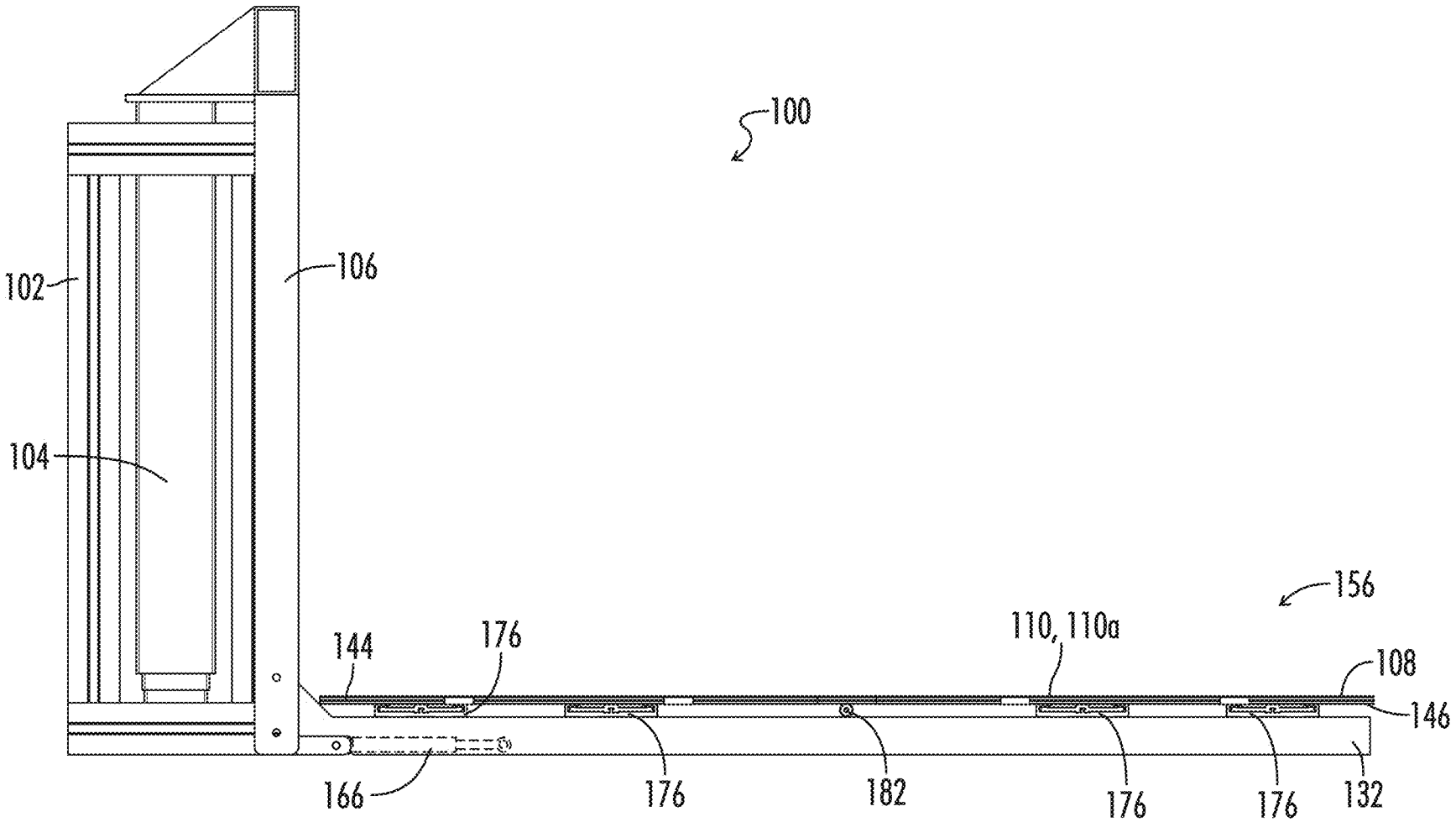
FIG. 22 illustrates a side view of an exemplary embodiment of the apparatus for positioning a mobility device of FIG. 20 having a lowered platform configuration according to aspects of the present disclosure.
Figure 23:
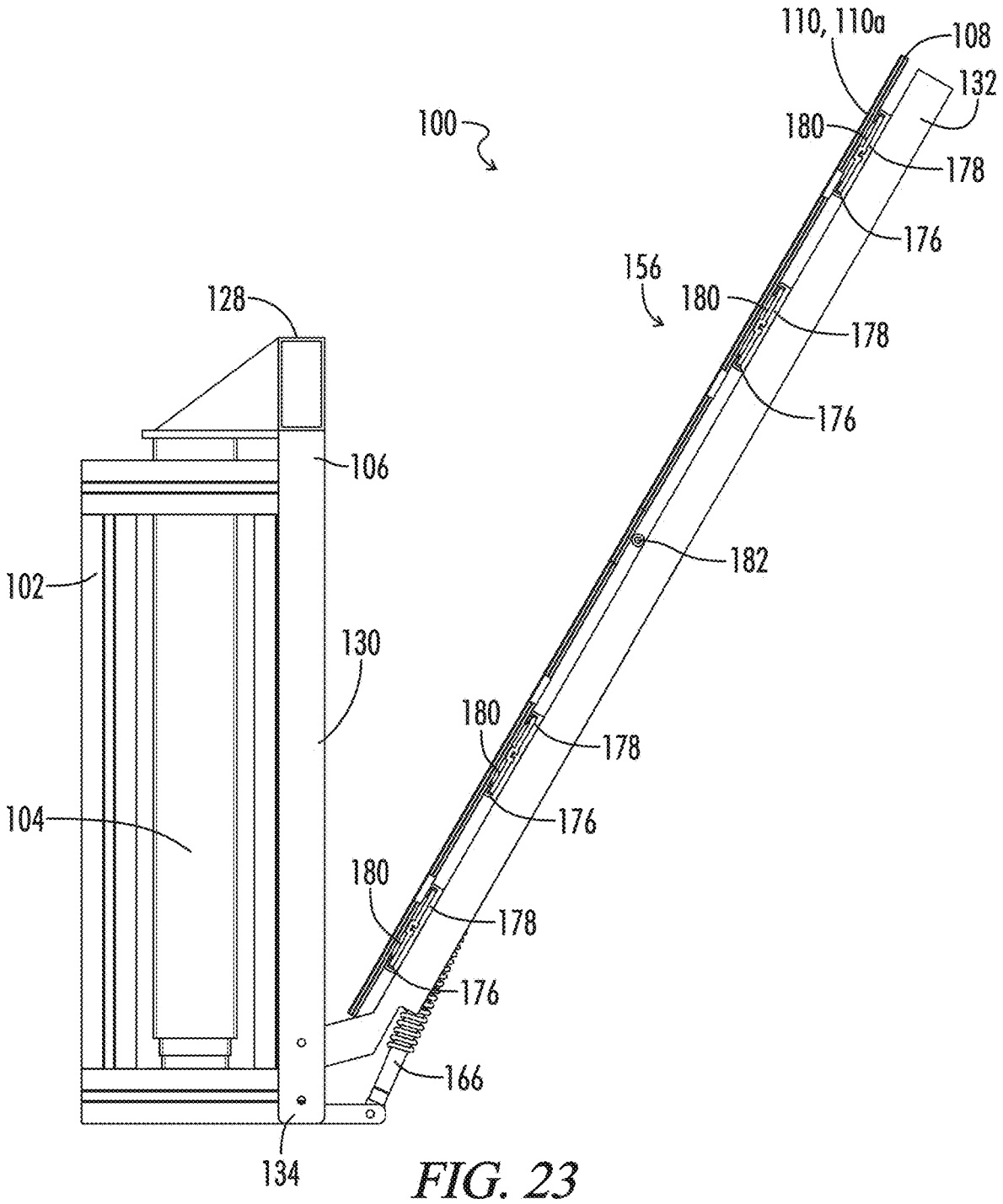
FIG. 23 illustrates a side view of an exemplary embodiment of the apparatus for positioning a mobility device of FIG. 20 having a partially-collapsed platform configuration according to aspects of the present disclosure.
Figure 24:
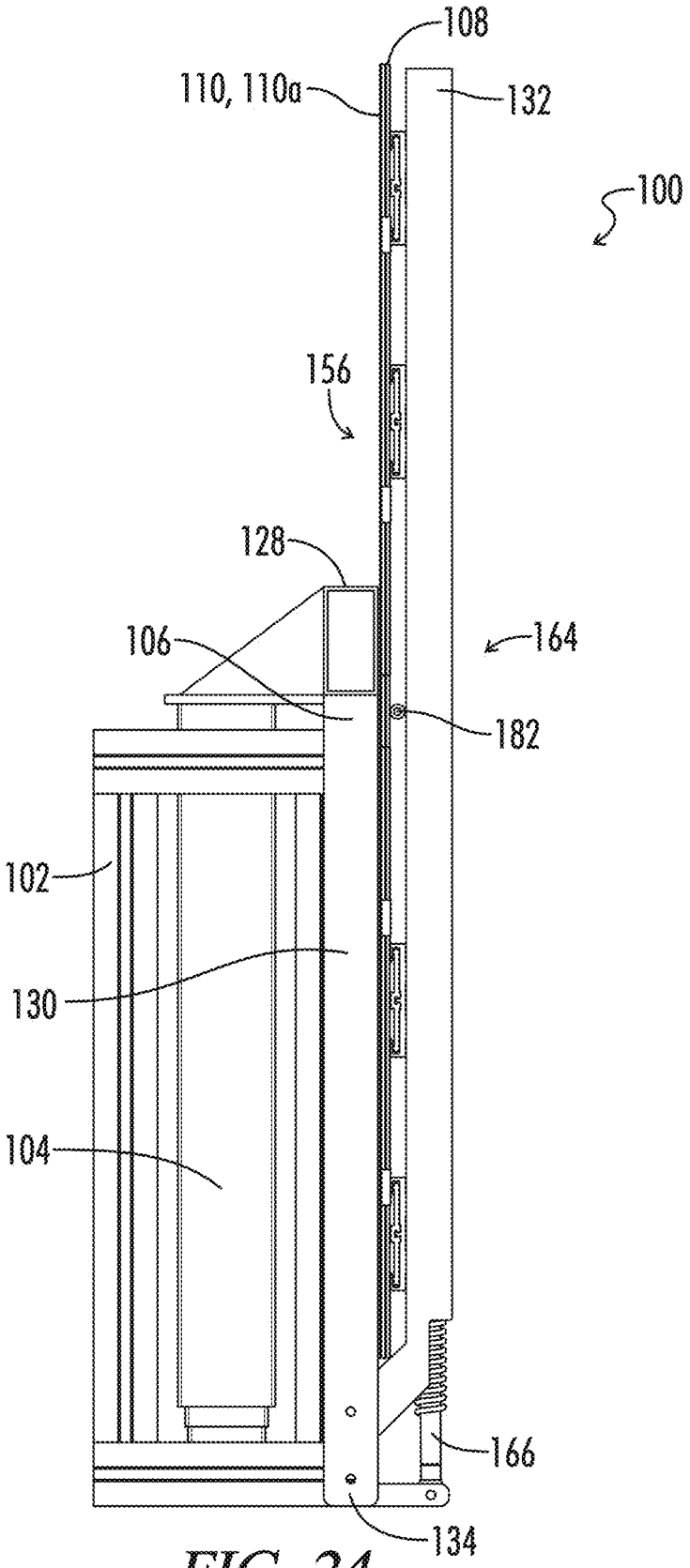
FIG. 24 illustrates a side view of an exemplary embodiment of the apparatus for positioning a mobility device of FIG. 20 having a fully-collapsed platform configuration according to aspects of the present disclosure.
Figure 27:
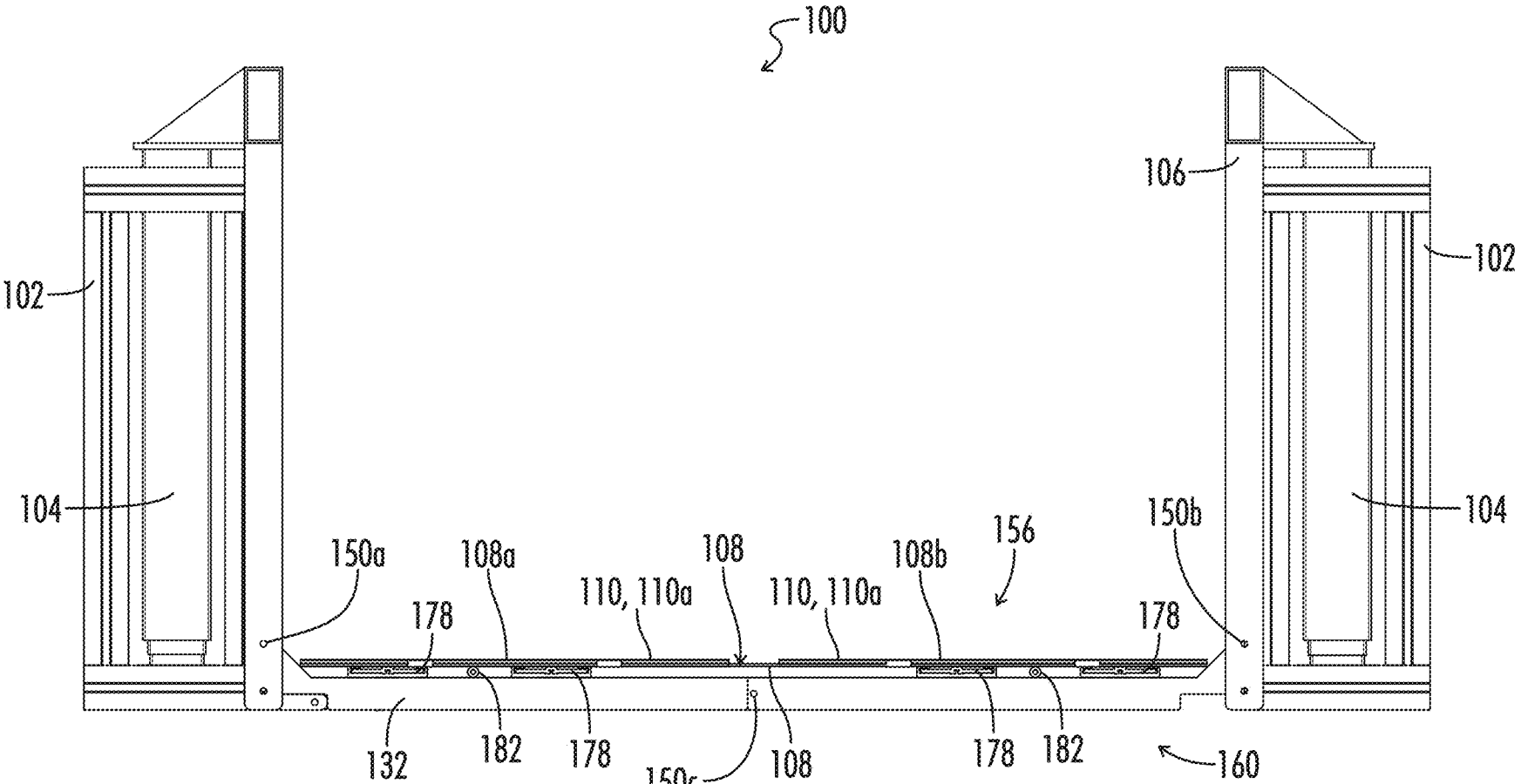
FIG. 27 illustrates a front view of an exemplary embodiment of the apparatus for positioning a mobility device of FIG. 25 having a lowered platform configuration according to aspects of the present disclosure.
Figure 28:
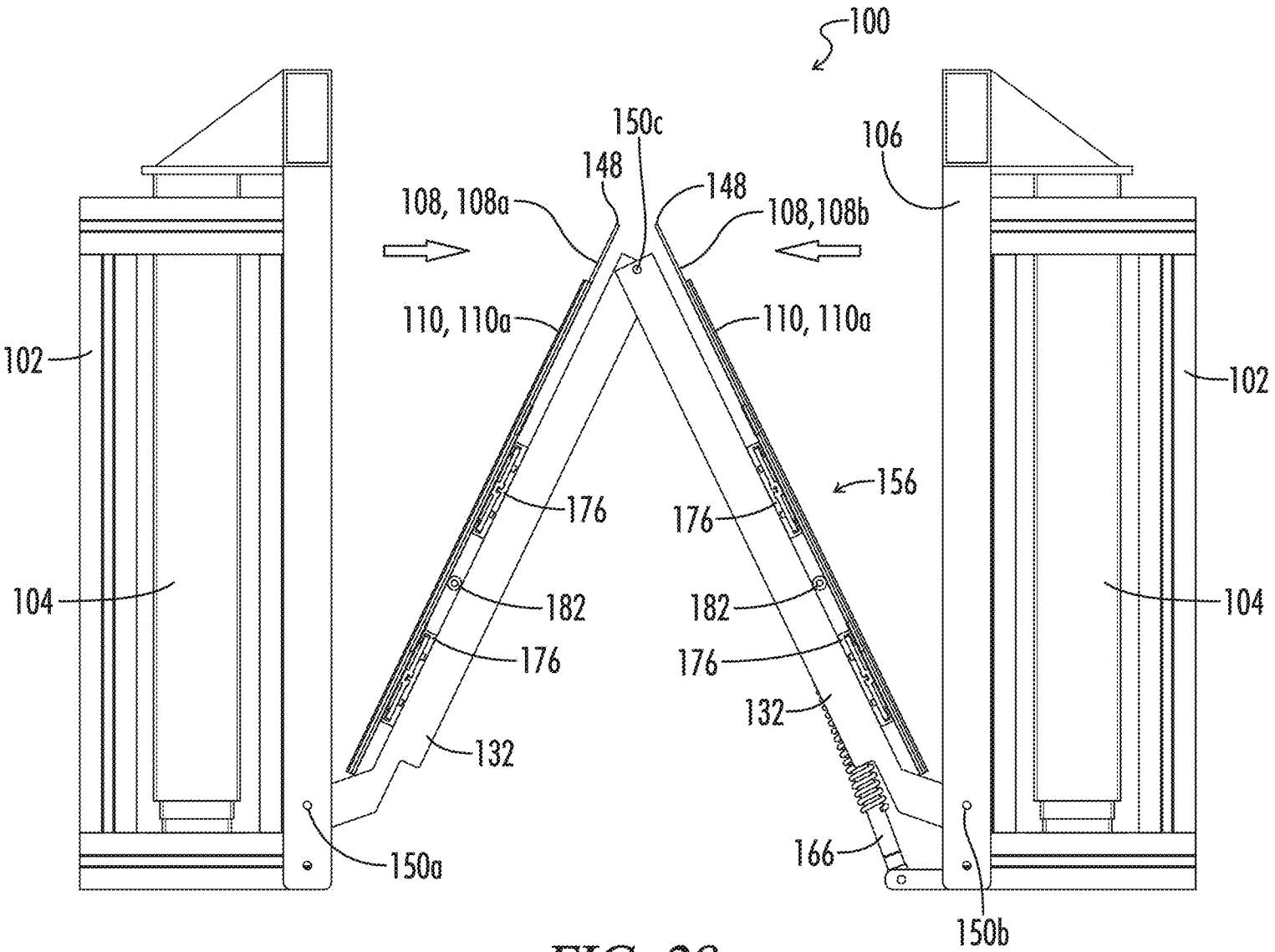
FIG. 28 a side view of an exemplary embodiment of the apparatus for positioning a mobility device of FIG. 25 having a partially-collapsed platform configuration according to aspects of the present disclosure.
Figure 29:
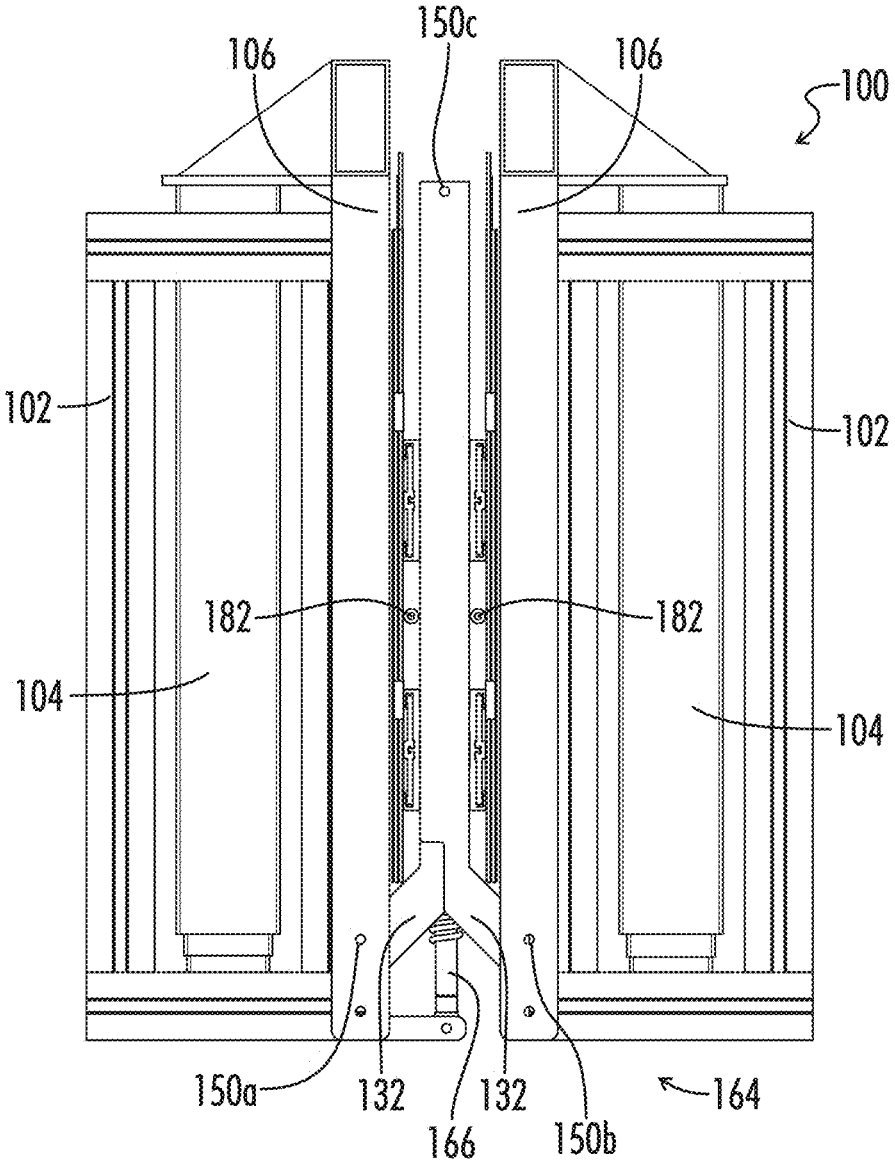
FIG. 29 illustrates a side view of an exemplary embodiment of the apparatus for positioning a mobility device of FIG. 25 having a fully-collapsed platform configuration according to aspects of the present disclosure.
Figure 30:
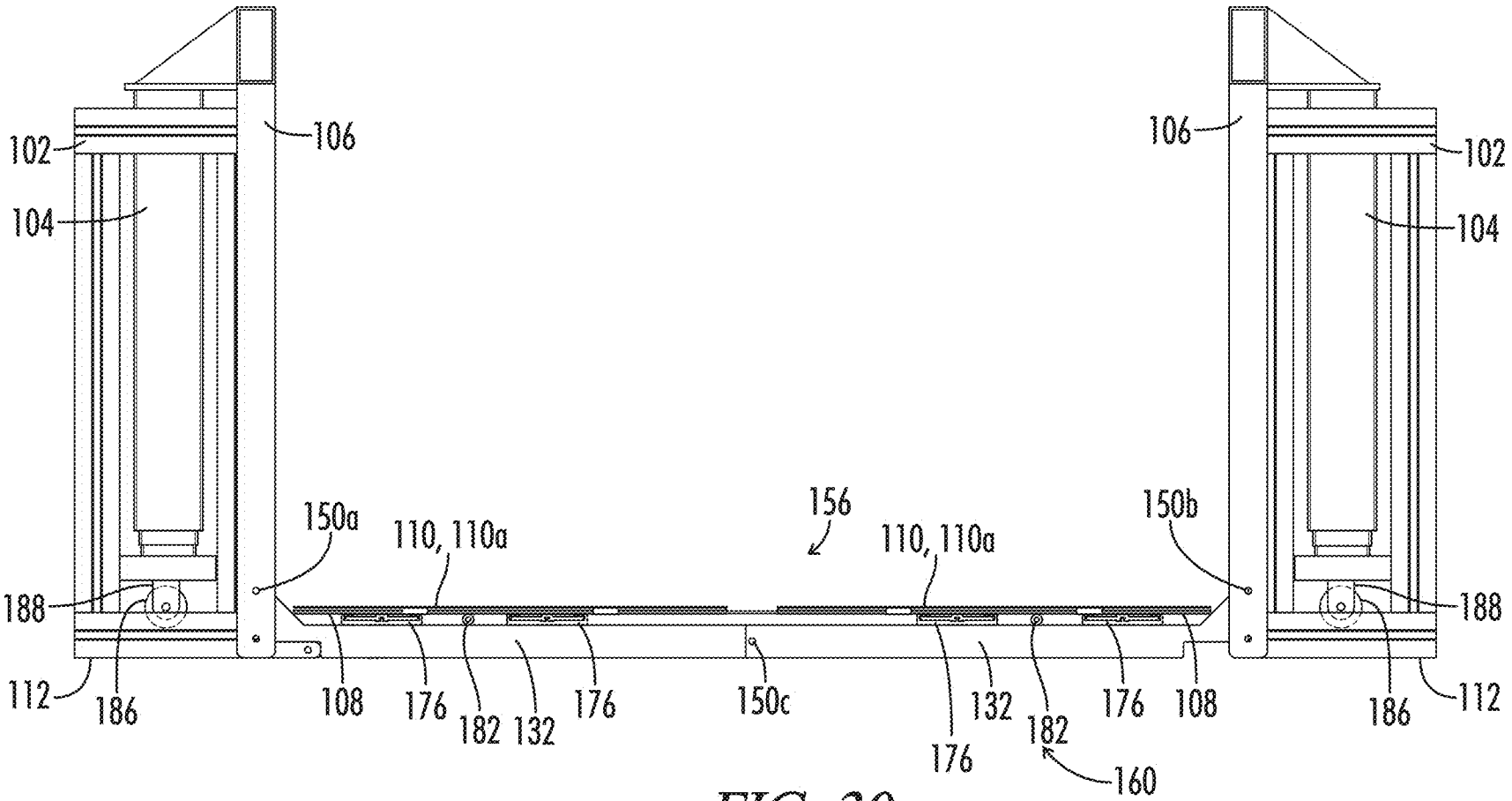
FIG. 30 illustrates a side view of an exemplary embodiment of the apparatus for positioning a mobility device of FIG. 25 having a plurality of wheels within each support structure according to aspects of the present disclosure.

A platform support assembly 106 is attachable to each lifting mechanism 104. In FIG. 20, the platform support assembly 106 is attached to the upper end 126 of the lifting mechanism 104. The platform support assembly 106 may have an upper support bar 128 positioned over the support structure 102, at least one vertical support 130 and at least one arm 132 attached to a lower portion 134 of the vertical support 130. Each arm 132 may pivotally attached to the lower portion 134 of the vertical support 130. In some embodiments, the platform support assembly 106 may attach to the upper end 126 of the lifting mechanism 104 through the side opening 120 of the support structure 102. One or more portions of the platform support assembly 106 may be welded, bolted, rigidly attached, or moveable. The pivotal connection of the arm 132 to the platform support assembly 106 may allow for the arm 132 to translate between a horizontal position (e.g. as shown in FIGS. 20-22) and a vertical position (e.g., as shown in FIGS. 23-24). In some embodiments, a platform 108 may be, pivotally or otherwise, coupled directly or indirectly to at least one vertical support 130. In some embodiments, each arm 132 may include multiple pieces pivotally connected together, for example as shown in the exemplary embodiment illustrated by FIGS. 27-29. The arm 132 may be foldable along one or more pivotal connections (e.g., first, second, and third pivot points 150*a*, 150*b*, 150*c*) to fold into a collapsed format when not in use. One or more arms 132 may be pivotally connected at each end to a vertical support 130, e.g., as shown in FIGS. 27-29.

The platform 108 may be coupled to an arm 132 of the platform support assembly 106. A position of the platform 108 may be directly or indirectly associated with the position of the platform support assembly 106. The platform 108 may include a first side edge 136, a second side edge 138, a front edge 140, and a back edge 142. The platform 108 may include an upper surface 144 for supporting a mobility device and a lower surface 146 attachable to at least one arm 132. Each of the first and second side edges 136, 138 may be parallel to the length L of the support structure 102, e.g., as shown by FIG. 20. The support structure 102 can be configured adjacent to any edge of the platform. In some embodiments, the platform 108 may include two pieces configured to fit together along a mating edge 148. The mating edge 148 may be generally parallel to the first and second side edges 136, 138 of the platform 108. The mating edge 148 may be positioned above a mid-arm pivotal connection 150*c*, shown in FIGS. 25-31, positioned between arm-pieces such that when the arm 132 pivots, the mating edge 148 is configured to separate or mate. The mid-arm pivotal connect 150*c* may also be referred to herein as the third pivot point 150*c*. The mating edge 148 in FIGS. 25-31 may have the shaped of a square wave. In some embodiments, the mating edge 148 may be straight, curved, zig-zag, or any like shape the like.

At least one ramp 110 may be coupled to the platform 108 (e.g., at an edge thereof). The at least one ramp 110 may be pivotally connected to the platform 108 and configured to pivot around the pivotal connection. The at least one ramp 110 may be configured to hold its orientation relative to the platform 108. In some embodiments the ramp 110 may selectively hold its position in a first position 152, a second position 154, and/or a third position 156. A ramp 110 in the first position 152 may have an edge in contact with a ground surface. A ramp 110 in the second position 154 may be substantially vertical such that it functions as a railing for the platform 108 to prevent a mobility device upon the platform 108 from rolling off. In the third position 156, a ramp 110 may be stored flat against the platform 108. Each ramp 110 may be positioned manually by rotating the ramp 110 between two or more positions. In various embodiments, each ramp 110 may include a ramp positioning mechanism 158 capable of controlling the position of the ramp 110.

In the exemplary embodiment of the apparatus 100 for positioning a mobility device illustrated by FIGS. 20-24, the apparatus 100 includes a single support structure 102 having two lifting mechanisms 104. The apparatus 100 may include a platform support assembly 106 coupled between the two lifting mechanisms 104 and a one-piece platform 108*a*. The first side edge 136 of the platform may be positioned adjacent the support structure 102. The apparatus 100 may further include a first ramp 110*a* pivotally connected to the front edge 140, a second ramp 110*b* pivotally connected to the back edge 142, and a third ramp 110*c* pivotally connect to the second side edge of the platform 108. As shown in FIG. 20, the platform 108 of the apparatus 100 may be in a lowered position 160. In the lowered position 160, the ramps 110*a*, 110*b*, 110*c* are in the first position 152, in contact with the ground surface. As shown in FIG. 21, the platform 108 of the apparatus 100 is in a lifted position 162. In the lifted position 162, the ramps 110*a*, 110*b*, 110*c* may be positioned substantially vertically in the second position 154. FIG. 23 shows the platform 108 partially folded midway between a collapsed format 164 and a non-collapsed format. FIG. 24 shows the platform in the collapsed format 164. In the collapsed format 164 of FIGS. 23-24, the ramps 110*a*, 110*b*, and 110*c* are positioned flat against the upper surface 144 of the platform 108 in the third position 156.

In the exemplary embodiment of the apparatus 100 for positioning a mobility device illustrated by FIGS. 25-32, the apparatus 100 includes two support structures 102 (e.g., a first support structure 102*a* and a second support structure 102*b*) having two lifting mechanisms 104 each (e.g., first and second lifting mechanisms 104*a*, 104*b* associated with the first support structure 102*a*, and third and fourth lifting mechanisms 104*c*, 104*d* associated with the second support structure 102*b*). The apparatus 100 may include a platform support assembly 106 coupled between the two lifting mechanisms 104 and a two-piece platform 108*b* having a first portion 108*a* and a second portion 108*b*. A first support structure 102*a* of the two support structures 102 is positioned adjacent the first side edge 136 of the two-piece platform 108*b*. A second support structure 102*b* of the two support structures 102 is positioned adjacent the second side edge 138 of the two-piece platform 108*b*. Each arm 132 of the platform support assembly 106 is pivotally connected at each end to vertical support 130. Each arm 132 of the platform support assembly 106 may include a mid-arm pivotal connection 150*c* between the ends of each arm 132. The platform 108 may include the mating edge 148 positioned above the mid-arm pivotal connection 150*c* of each arm 132. The apparatus 100 may further include a first ramp 110*a* pivotally connected to the front edge 140 of the platform 108 and a second ramp 110*b* pivotally connected to the back edge 142 of the platform 108. The first ramp 110*a* and second ramp 110*b* may include two pieces divided along the mating edge 148 of the platform 108. As shown in the exemplary embodiment illustrated by FIG. 25, the platform 108 of the apparatus 100 is in a lowered position 160. In this embodiment, the lowered position 160, the ramps 110*a*, 110*b* are in the first position 152 and in contact with the ground surface. As shown in the exemplary embodiment illustrated by FIG. 26, the platform 108 of the apparatus 100 is in a lifted position 162. In the lifted position 162, the ramps 110*a*, 110*b* are positioned substantially vertically in the second position 154. FIG. 28 illustrates the platform 108 partially folded into a collapsed format 164. FIG. 29 illustrates the platform 108 fully folded in the collapsed format 164. In the vertical collapsed format 164, the ramps 110*a*, 110*b* are positioned flat against the upper surface 144 of the platform 108 (e.g., in the third position 156).

Figure 31:
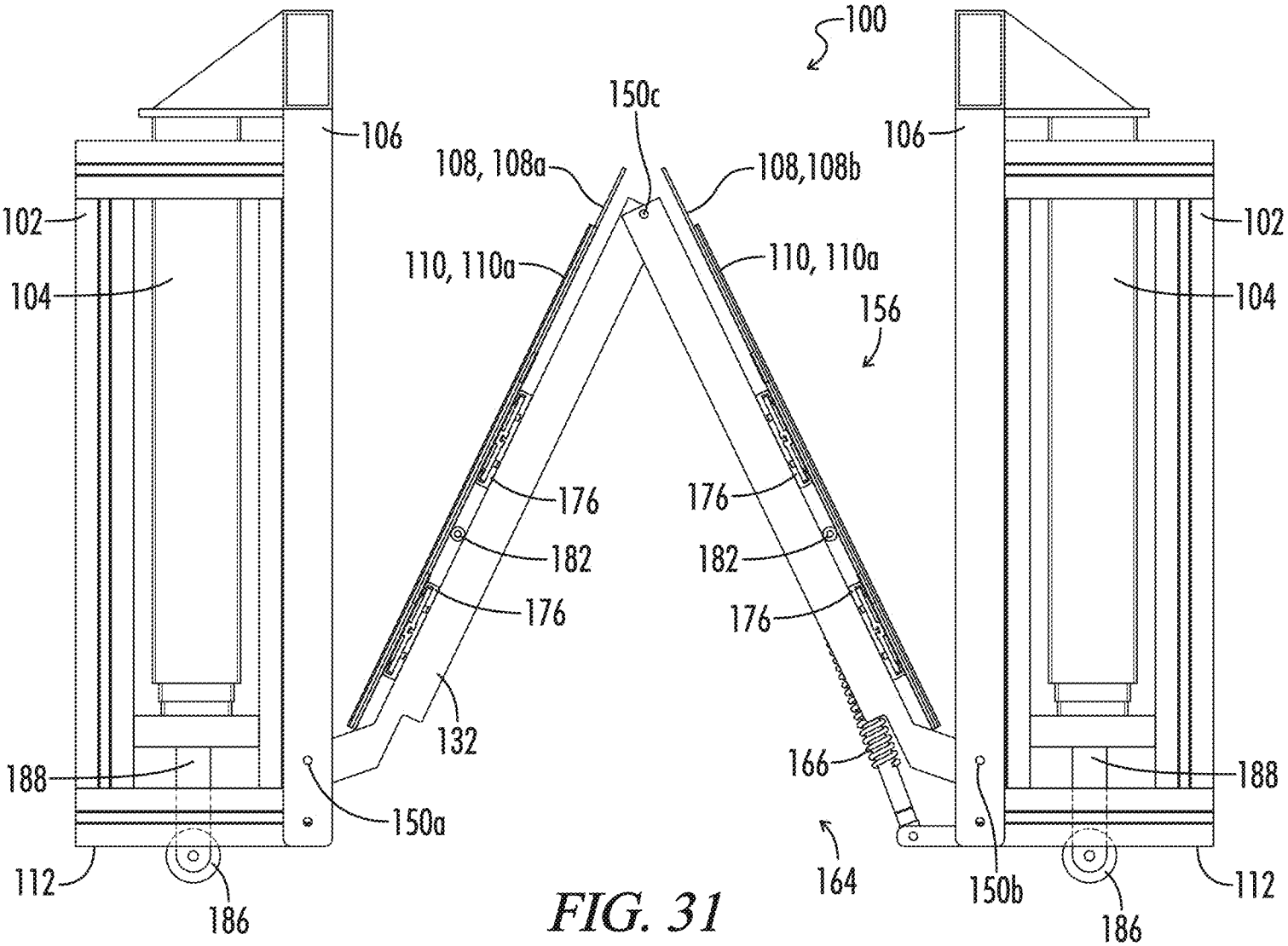
FIG. 31 illustrates a side view of an exemplary embodiment of the apparatus for positioning a mobility device of FIG. 30 having a plurality of wheels extending from each support structure according to aspects of the present disclosure.

In some embodiments, the apparatus 100 may include at least one platform storage mechanism 166, as shown in FIGS. 28, 29, and 31. The platform storage mechanism 166 may be coupled between a lower portion 134 of a vertical support 130 and an arm 132. The platform storage mechanism 166 may optionally be configured to fold the platform 108 into the collapsed format 164 without the assistance of a user. In other embodiments, the platform storage mechanism 166 may assist a user in manually folding the platform 108 into the collapsed format 164 or into the lowered position 160 from the collapsed format 164. The platform storage mechanism 166 may be any electric, mechanical, hydraulic actuator, shock, spring, or the like.

Figure 32:
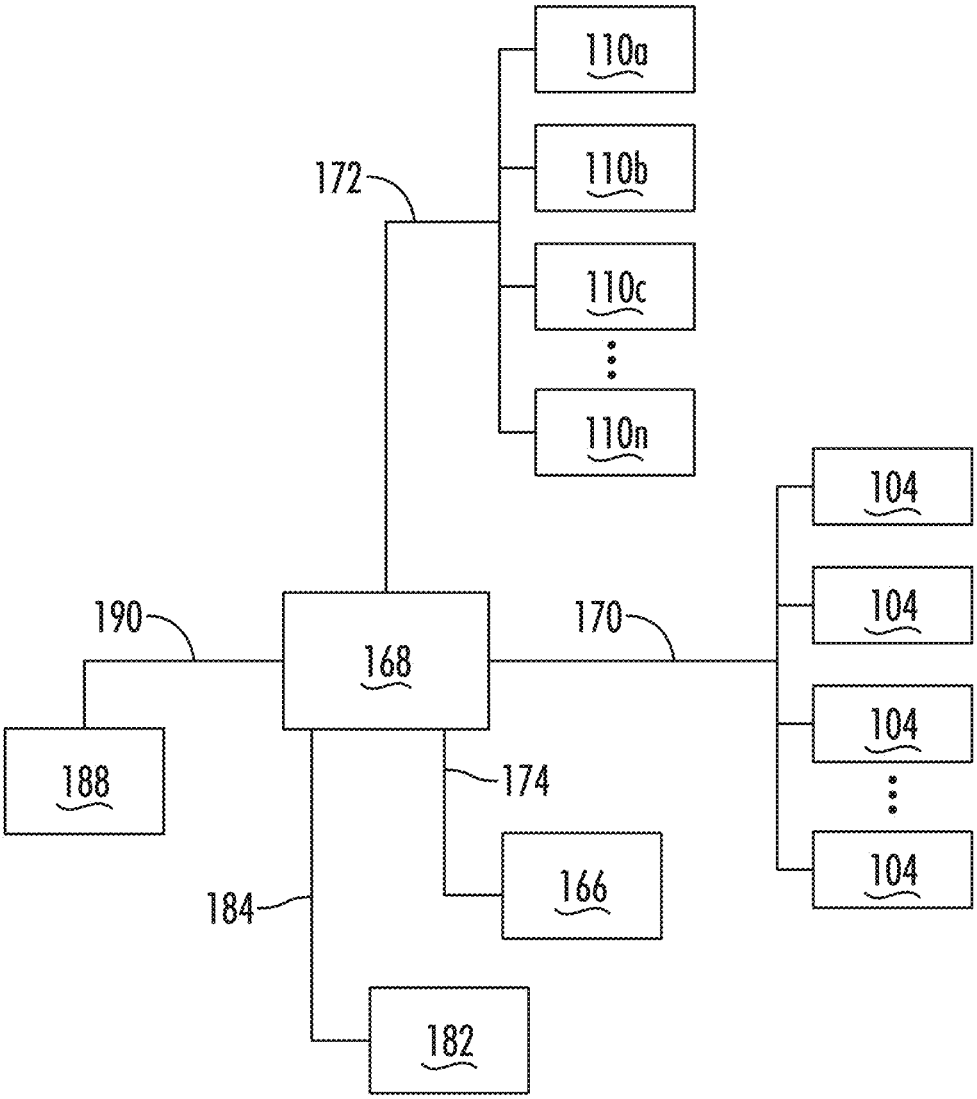
FIG. 32 illustrates a block diagram of an exemplary control system according to aspects of the present disclosure.

In some embodiments, the apparatus 100 may include a control system 168 (e.g., a control unit), as shown in FIGS. 21 and 32. The control system 168 may be configured to transmit a lifting control signal 170 to the at least one lifting mechanism 104. The control system 168 may be configured to transmit a ramp positioning signal 172 to the at least one ramp control mechanism 158, as shown in FIG. 32. The control system 168 may be configured to transmit a folding control signal 174, as shown in FIG. 32, to the at least one platform storage mechanism 166. In some embodiments, the control system 168 may include a user interface. In other embodiments, the control system 168 may be communicatively linked with an electronic device.

In various exemplary embodiments, one or more portions of the control system 168 may be implemented by a computing device, such as at least one of a desktop computer, a laptop computer, a smart phone, or any other electronic device capable of executing instructions. The computing device may include a microprocessor configured to take the form of a generic hardware processor, a special-purpose hardware processor, or a combination thereof. In embodiments having a generic hardware processor (e.g., as a central processing unit (CPU) available from manufacturers such as Intel and AMD), the generic hardware processor is configured to be converted to a special-purpose processor by means of being programmed to execute and/or by executing a particular algorithm in the manner discussed herein for providing a specific operation or result.

The computing device is configured in various embodiments to be associated with a mobility device user, and is capable of being transported, either during operation or while powered off. In various embodiments, the computing device is configured to operate remotely, and is configured to obtain or otherwise operate upon one or more instructions stored physically remote from the computing device (e.g., via client-server communications and/or cloud-based computing).

The computing device may include a display unit. The display unit is embodied within the computing device and/or a mobility device lifting and positioning device or component thereof in various embodiments, and is configured to be either wired to or wirelessly-interfaced with the computing device. The display unit may be configured to operate, at least in part, based upon one or more operations of an application, as executed by the microprocessor. In one exemplary embodiment, the application may include an internet browser configured to obtain at least one set of information and display at least a portion of a representation thereof to a user of the computing device via the display unit. Although operable using the display unit of computing device, the application may be capable of executing and operating using a plurality of devices. For example, one or more computing devices may include smart phones, tablets, laptop computers, etc., optionally each having different microprocessors, screen resolutions, memory sizes, etc., but each being capable of executing the application after download and/or installation of at least a port of the application from a server or any other source of downloadable application information. Additionally or alternatively, at least a portion of the application or information associated with the application may be previously installed on the computing device, such as via manufacturer factory installation settings and/or as a part of an operating system of the computing device. The computing device may optionally include an input unit, for example a keyboard or other input means, and the computing device may be configured to store at least a portion of input received by the input unit or a representation thereof at via at least one of a storage device or location, the server, and/or a remote device.

One or more command devices may be configured to communicate and/or provide information to the control system 168 via one or more computing devices.

In some embodiments, the apparatus 100 may include a cantilevered or other guide system 176 configured to permit the platform 108 to move laterally, e.g., in a direction parallel to the length L of the at least one support structure 102. The cantilevered guide system 176 may include at least one first rail 178 connected to an arm 132. The first rail 178 may be slidably coupled to a second rail 180, such that each first and second rail may be paired together. The at least one second rail 180 may be connected to a lower surface 146 of the platform 108. The guide system 176 may further include a horizontal positioning mechanism 182 coupled between at least one first and second rails 178, 180. The horizontal positioning mechanism 182 may be configured to receive a horizontal movement control signal 184 from the control system 168. The cantilever guide system 176 may allow for fine tuning of a lateral position of the platform 108. The lateral position may be parallel to the length L of the support structure 102. This may help in situating the apparatus 100 where a bar or other establishment has a foot-rail or other obstacle adjacent to an elevated surface that forces the apparatus 100 to be operated from a greater distance from the elevated surface.

In some embodiments, the apparatus 100 may include a plurality of wheels 186 coupleable to the support structure 102. Although illustrated as a plurality of wheels, it should be appreciated that a single wheel 186 may be used in various embodiments. In some embodiments, the plurality of wheels 186 may be coupled directly to the lower surface 112 of the support structure 102. In other embodiments, the plurality of wheels may be selectively engageable using a wheel engagement mechanism 188. The wheel engagement mechanism 188 may be manually operated. In other embodiments, the wheel engagement mechanism 188 may be coupled to the control system 168. The control system 168 may be configured to transmit a wheel engagement signal 190 to the wheel engagement mechanism 188, as shown in FIG. 32. The plurality of wheels 186 may be engaged with a ground surface when the apparatus 100 is not in use. Such a feature would allow for easy movement, positioning and storage to the apparatus 100 when not in use. The wheels 186 may be mounted to a wheel plate (not illustrated), the wheel plate attached to the wheel engagement mechanism 188 to move all wheels simultaneously. The wheels 186 may be easily disengaged by retracting them within the support structure 102 or by locking when the apparatus 100 is positioned and ready for use. When ready for use, the disengagement of the plurality of wheels 186 may enable the lower surface 112 of the support structure 102 to rest upon a ground surface, thus increasing stability and ensuring that the apparatus 100 does not move during operation. In some embodiments, the wheels 186 may include controllable electronic assistance for moving and positioning the apparatus 100. In other embodiments, the wheels 186 may be mounted to the apparatus 100 and configured to engage the ground surface only when the apparatus 100 is tilted relative to the ground surface.

In some embodiments, the apparatus 100 may include an auxiliary stabilization system 192, shown in FIG. 21, coupleable to the support structure 102. The auxiliary stabilization system 192 may include at least one outrigger 194 that extend from the support structure 102 along the ground surface. Additionally, each outrigger 194 may detach from the support structure 102, fold flat against the support structure 102 or retract within the support structure 102 when the apparatus is not in use. The auxiliary stabilization 192 system is useful when utilizing the apparatus 100 with only one support structure 102.

In some embodiments, the apparatus 100, may include a safety system (not shown) to ensure that a mobility device cannot fall or tip from the platform 108 when in the lifted position 162. The safety system may include straps, wheel channels, wheel clamps, or the like.

Figure 25:
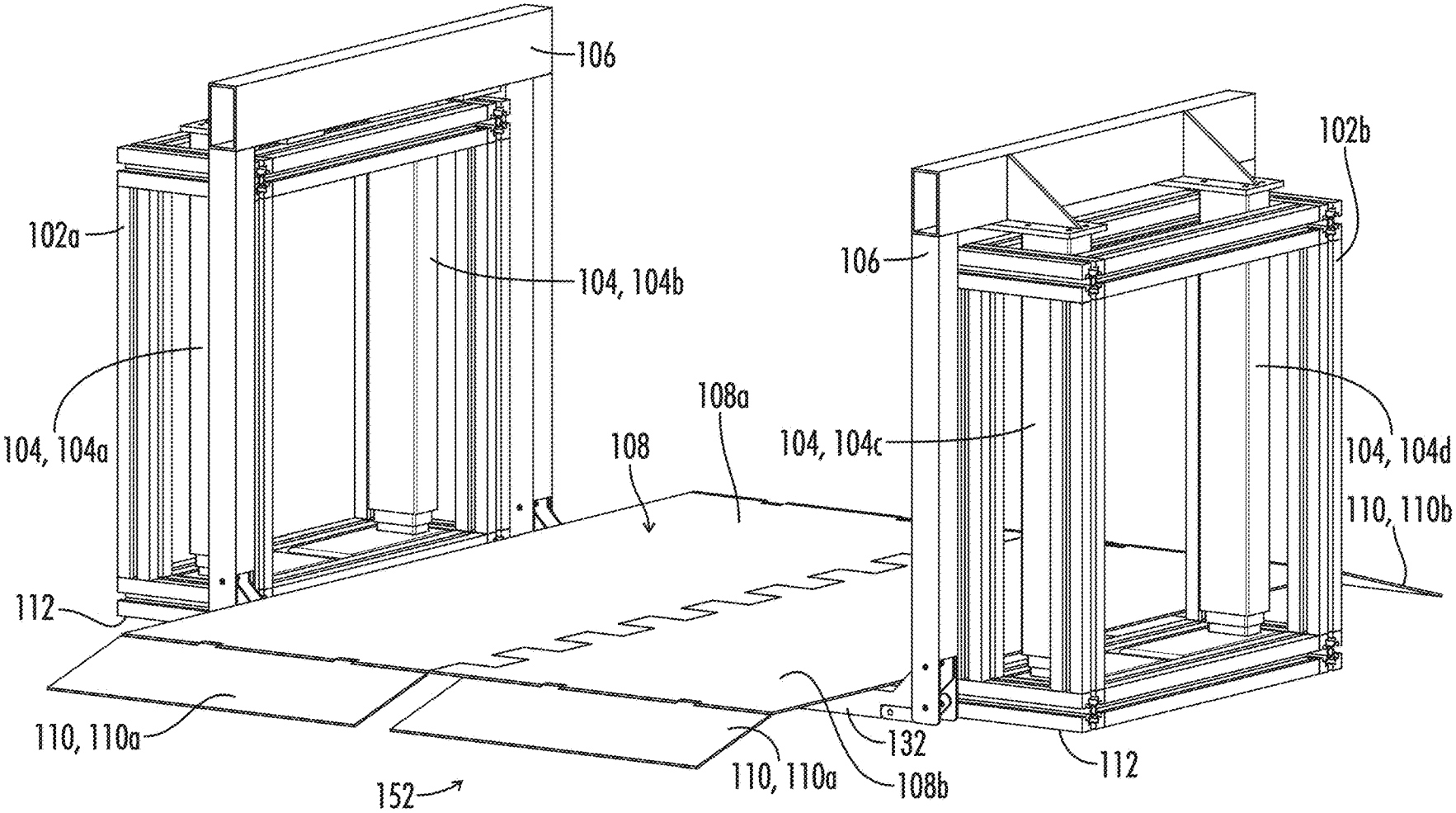
FIG. 25 illustrates a raised front, side perspective view of an exemplary embodiment of an apparatus for positioning a mobility device having a double support structure configuration according to aspects of the present disclosure.
Figure 26:
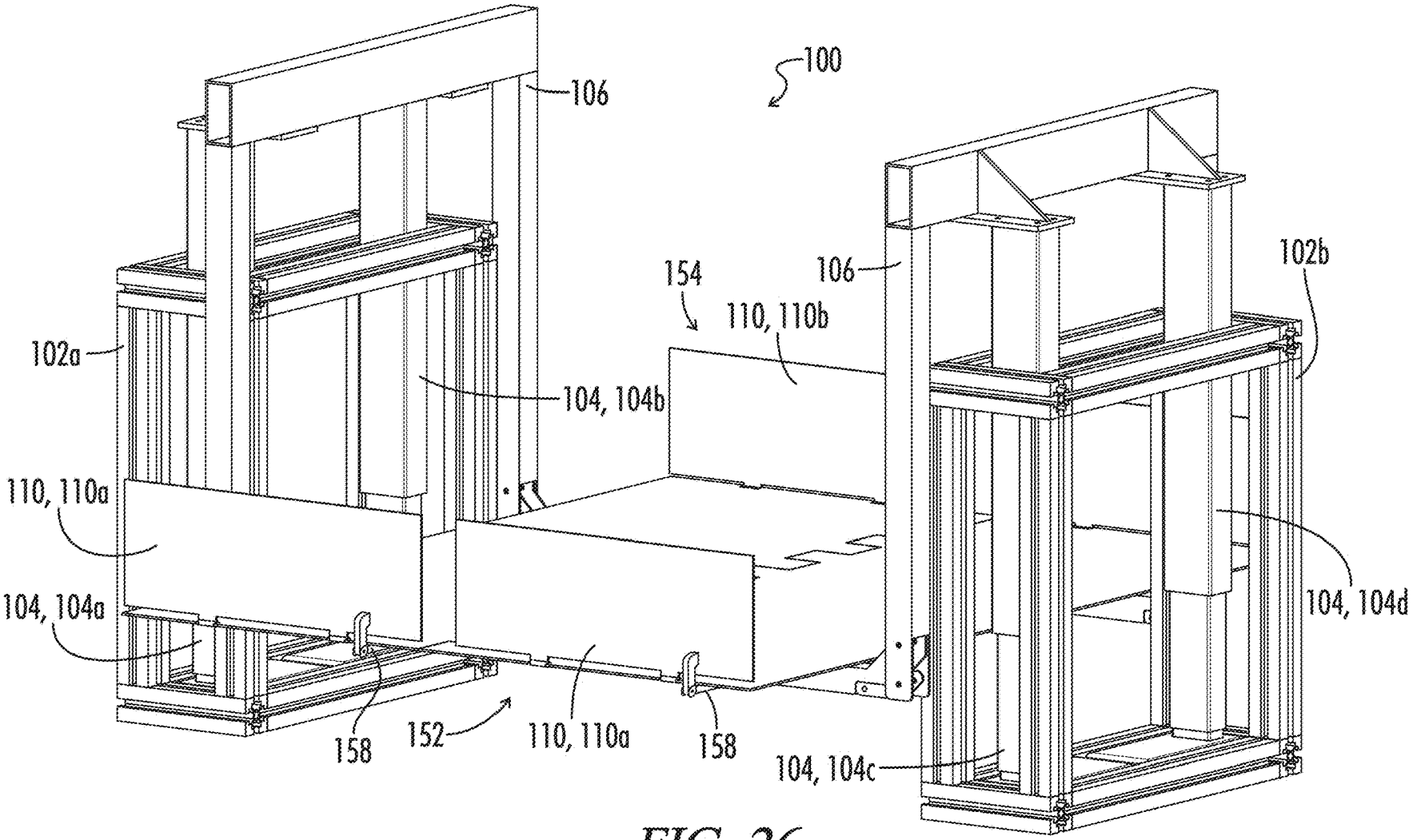
FIG. 26 illustrates a raised front, side perspective view of an exemplary embodiment of the apparatus for positioning a mobility device of FIG. 25 in a lifted platform configuration according to aspects of the present disclosure.

The apparatus 100 may be operable to move the platform 108 vertically between the lowered position, shown in FIGS. 20 and 25, and the lifted position, shown in FIGS. 21 and 26. The apparatus 100 may also be operable to move the platform 108 laterally with respect to the support structure 102.

A plurality of lifting mechanisms 104 may be operated in unison to lift the platform off the ground surface and/or to keep the platform 108 level in various embodiments.

In other embodiments, the apparatus 100 can have a support structure 102 affixed to a wall or other permanent structure near an elevated surface. The apparatus 100 may be configured to unfold from said wall or other permanent or semi-permanent structure when being used and further configured to fold back against the wall or other permanent or semi-permanent structure when not in use. In such a configuration, the apparatus 100, may be configured to fold easily out of the way when not in use and to easily unfold for use. This arrangement has many potential uses including, for example, in individual homes where space, especially corridor space, may be limited.

FIGS. 33A-33D illustrate an apparatus 100 for positioning a mobility device including support structures 102, side rails 196, a platform 108, ramps 110, and a remote 198. Each support structure may be coupled to a side rail 196. Each side rail may include at least side opening 120. The apparatus 100 may include at least one lifting mechanism housed at least in part within one or more support structure 102. The platform 108 may be directly or indirectly connected pivotally to the at least one lifting mechanism. A mobility device such as a wheelchair may be placed upon the platform 108, for example using a ramp 110 to access the platform. Once on the platform 108, a mobility device user or other command source (e.g., such as a caregiver, employee, third-party, or other user) may initiate a lifting process by activating or transmitting a lifting command, for example via the remote 198. One or more ramps 110 may be configured to automatically position vertically in response to the lifting command in an exemplary embodiment. The platform 108 may be configured to rise to a specified height in response to the lifting command, for example at least in part using a control unit as previously described herein. Once at the specified height, the user or other command source may initiate a horizontal movement command using the remote 198. The platform 108 may be configured to move horizontally at least in part responsive to the horizontal movement command. To return to a ground surface or other default position, the user or other command source may initiate a home command on the remote 198. The platform may be configured to move horizontally to a centered or other default position, the platform may lower to a bottom position, and the ramps may be configured to unfold, all at least in part responsive to the home command.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An apparatus for positioning a mobility device above a ground surface, the apparatus comprising:

at least one support structure including a lower surface, a plurality of retractable wheels, and at least one lifting mechanism, the at least one support structure supported on the ground surface using one of the lower surface or the plurality of retractable wheels; and a platform coupled to the at least one lifting mechanism, the platform pivotally configurable in at least one of a collapsed configuration or a non-collapsed configuration, wherein the plurality of retractable wheels are configured to extend beyond the lower surface of the at least one support structure in response to the collapsed configuration for supporting the at least one support structure on the ground surface.

2. The apparatus of claim 1, wherein:

the at least one support structure includes a first support structure;

the platform includes a first side edge and a second side edge opposite to the first side edge, the first side edge positioned adjacent to the first support structure; and the first side edge is positioned closer to the ground surface than the second side edge when the platform is in the collapsed configuration.

3. The apparatus of claim 1, wherein:

the at least one support structure includes a first support structure;

the platform includes a first side edge and a second side edge opposite to the first side edge, the first side edge positioned adjacent to the first support structure; and the first and second side edges are positioned substantially a same distance from the ground surface when the platform is in the non-collapsed configuration.

4. The apparatus of claim 3, wherein:

the plurality of retractable wheels are configured to retract within the at least one support structure in response to the non-collapsed configuration.

5. The apparatus of claim 1, further comprising:

at least one ramp pivotally coupled to an edge of the platform.

6. The apparatus of claim 5, wherein:

the platform includes a first edge and a second edge, the first and second edges extending away from the at least one support structure; and the at least one ramp includes a first ramp coupled along the first edge of the platform and includes a second ramp coupled along the second edge of the platform.

7. The apparatus of claim 5, wherein:

the at least one ramp includes a ramp actuator coupled between the at least one ramp and the platform; and the ramp actuator is configured to position the at least one ramp selectively between at least a first position and a second position.

8. The apparatus of claim 1, further comprising:

a platform support assembly coupled between the at least one lifting mechanism and the platform, the platform support assembly including at least one arm pivotally attached thereto for moving the platform between the collapsed and non-collapsed configurations.

9. The apparatus of claim 8, further comprising:

a guide rail system coupled between the platform and the at least one arm of the platform support assembly, the guide rail system configured to adjust a horizontal position of the platform relative to the at least one support structure.

10. The apparatus of claim 8, wherein:

the at least one support structure includes a first support structure and a second support structure; and the at least one arm of the platform support assembly is coupled between the at least one lifting mechanism of each of the first and second support structures.

11. The apparatus of claim 10, wherein:

the at least one arm includes a first pivot point positioned proximate to the first support structure, includes a second pivot point positioned proximate to the second support structure, and includes a third pivot point positioned between the first pivot point and the second pivot point.

12. The apparatus of claim 11, wherein:

the platform is coupled to the at least one arm between the first pivot point and the third pivot point, or between the second pivot point and the third pivot point.

13. The apparatus of claim 1, further including:

at least one outrigger configured to extend from the first support structure along the ground surface in the non-collapsed configuration.

14. A method of using a lifting device configured for positioning a mobility device above a ground surface, the method comprising:

pivotally transitioning a lifting platform of the lifting device into one of a first configuration or a second configuration; and moving a plurality of wheels of the lifting device between an extended position and a retracted positioned in response to pivotally transitioning the lifting platform into one of the first configuration or the second configuration, the extended position associated with the plurality of wheels extending beyond a lower surface of the lifting device.

15. The method of claim 14, further comprising:

extending the plurality of wheels beyond a lower surface of the lifting device in response to transitioning the lifting platform into the first configuration.

16. The method of claim 14, further comprising:

retracting the plurality of wheels within the lifting device in response to transitioning the lifting platform into the second configuration.

17. The method of claim 14, further comprising:

receiving a mobility device upon the lifting platform of the lifting device when the lifting platform is in the second configuration;

receiving a position command at a control unit of the lifting device; and adjusting a height of the lifting platform relative to the ground surface based upon the received position command.

18. The method of claim 17, further comprising:

receiving a lateral movement command at the control unit; and manipulating a lateral position of the lifting platform relative to at least one support structure of the lifting device based at least in part upon the received lateral movement command.

19. The method of claim 14, further comprising:

assisting transitioning the platform between the first configuration and the second configuration using an actuator, the actuator controlled at least in part by a control unit of the lifting device.

20. The method of claim 14, further comprising:

manipulating a position of at least one ramp coupled to the lifting platform from a lowered position resting on the ground surface to a raised position based at least in part on a command from a control unit of the lifting device.

* * * * *